US009342042B2

(12) United States Patent
Ohashi et al.

(10) Patent No.: US 9,342,042 B2
(45) Date of Patent: May 17, 2016

(54) IMAGE FORMING APPARATUS

(71) Applicant: KYOCERA Document Solutions Inc., Osaka (JP)

(72) Inventors: Hiroaki Ohashi, Osaka (JP); Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/715,503

(22) Filed: May 18, 2015

(65) Prior Publication Data

US 2015/0362889 A1 Dec. 17, 2015

(30) Foreign Application Priority Data

Jun. 13, 2014 (JP) ..... 2014-122111
Nov. 19, 2014 (JP) ..... 2014-234135

(51) Int. Cl.
*G03G 21/16* (2006.01)
*G03G 21/18* (2006.01)

(52) U.S. Cl.
CPC ..... *G03G 21/1676* (2013.01); *G03G 21/1623* (2013.01); *G03G 21/1633* (2013.01); *G03G 21/1821* (2013.01); *G03G 21/1825* (2013.01); *G03G 21/1842* (2013.01); *G03G 2221/1654* (2013.01)

(58) Field of Classification Search
CPC ..... G03G 15/0813; G03G 21/16; G03G 21/1633; G03G 21/1676; G03G 2221/1609; G03G 2221/1654
See application file for complete search history.

(56) References Cited

U.S. PATENT DOCUMENTS 7,463,847 B2 * 12/2008 Sato ..... G03G 15/01 399/119
2007/0092280 A1 * 4/2007 Nakazato ..... G03G 15/5004 399/75
2008/0107445 A1 5/2008 Yamaguchi ..... 399/111
2012/0063808 A1 * 3/2012 Matsuda ..... G03G 21/1647 399/111
2015/0227110 A1 8/2015 Yoshimura et al.

FOREIGN PATENT DOCUMENTS

JP 2008-116798 A 5/2008
JP 2011-191603 A 9/2011
WO WO 2014/038725 A1 3/2014

* cited by examiner

*Primary Examiner* — Erika J Villaluna
(74) *Attorney, Agent, or Firm* — Stein IP, LLC

(57) ABSTRACT

An image forming apparatus includes an image carrier unit, a developing device, a unit support frame, a retainer, and a developing device moving mechanism. The retainer swings in a first direction, in which the image carrier unit and the developing device are mounted in the unit support frame, to perform positioning of an image carrier, and swings in a second direction, in which the image carrier unit and the developing device are drawn out from a main body of the image forming apparatus, to unlock a positioned state of the image carrier. The developing device moving mechanism associates with the swing of the retainer in the first direction to dispose the developing device at a developing position, and associates with the swing of the retainer in the second direction to dispose the developing device at a separation position.

7 Claims, 17 Drawing Sheets

IMAGE FORMING APPARATUS

INCORPORATION BY REFERENCE

The present application is based on and claims the benefit of priority from Japanese Patent Application Nos. 2014-122111 filed on Jun. 13, 2014 and 2014-234135 filed on Nov. 19, 2014, the contents of which are hereby incorporated by reference.

BACKGROUND

The present disclosure relates to image forming apparatuses such as a copy machine, a printer, a facsimile and the like, more particularly, to an image forming apparatus that includes a developing device and an image carrier unit which are removably mounted in the image forming apparatus.

In a conventional image forming apparatus, because of life of a photosensitive drum (image carrier), when the number of printed sheets reaches a predetermined number (e.g., several dozens of thousands of sheets), it is necessary to replace a drum unit (image carrier unit) that includes the photosensitive drum. Besides, also there is a case where maintenance and replacement of a developing device disposed adjacently to the drum unit are required.

Here, a developing roller of the developing device is disposed to be in contact with or near the photosensitive drum. Because of this, when replacing the drum unit or the developing device, there is a risk that the photosensitive drum and the developing roller could contact each other to damage surfaces of the photosensitive drum and the developing roller.

Accordingly, various mechanisms are devised, in which the photosensitive drum and the developing device are mountable and demountable with ease, and for example, a structure is known, in which a process cartridge (image forming unit) integrating the photosensitive drum and the developing device is mountable in and demountable from an image forming apparatus main body.

Besides, an image forming apparatus is known, which includes a roller contact-separation mechanism that prevents the photosensitive drum and the developing roller from being damaged when replacing the drum unit or the developing device. This image forming apparatus includes a holder member (drum positioning unit) on which a positioning plate for positioning a drum shaft of the photosensitive drum is mounted; after the developing device is mounted in the image forming apparatus main body, the developing roller is made to contact the photosensitive drum in accordance with a closing operation of the holder member, and the developing roller is made to evacuate from the photosensitive drum in accordance with an opening operation of the holder member.

SUMMARY

An image forming apparatus according to an aspect of the present disclosure includes an image carrier unit, a developing device, a unit support frame, a retainer, and a developing device moving mechanism. The image carrier unit has an image carrier. The developing device has a developer carrier for supplying toner onto the image carrier and is disposed adjacently to the image carrier unit. The unit support frame separately supports the image carrier unit and the developing device in a mountable/demountable manner. The retainer swings in a first direction, in which the image carrier unit and the developing device are mounted in the unit support frame, to perform positioning of the image carrier, and swings in a second direction, in which the image carrier unit and the developing device are drawn out from an image forming apparatus main body, to unlock a positioned state of the image carrier. The developing device moving mechanism associates with the swing of the retainer in the first direction to dispose the developing device at a developing position where the developer carrier comes into contact with or comes close to the image carrier, and associates with the swing of the retainer in the second direction to dispose the developing device at a separation position where the developer carrier separates from the image carrier.

Still other objects of the present disclosure and specific advantages obtained by the present disclosure will become more apparent from the following embodiments described hereinafter.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
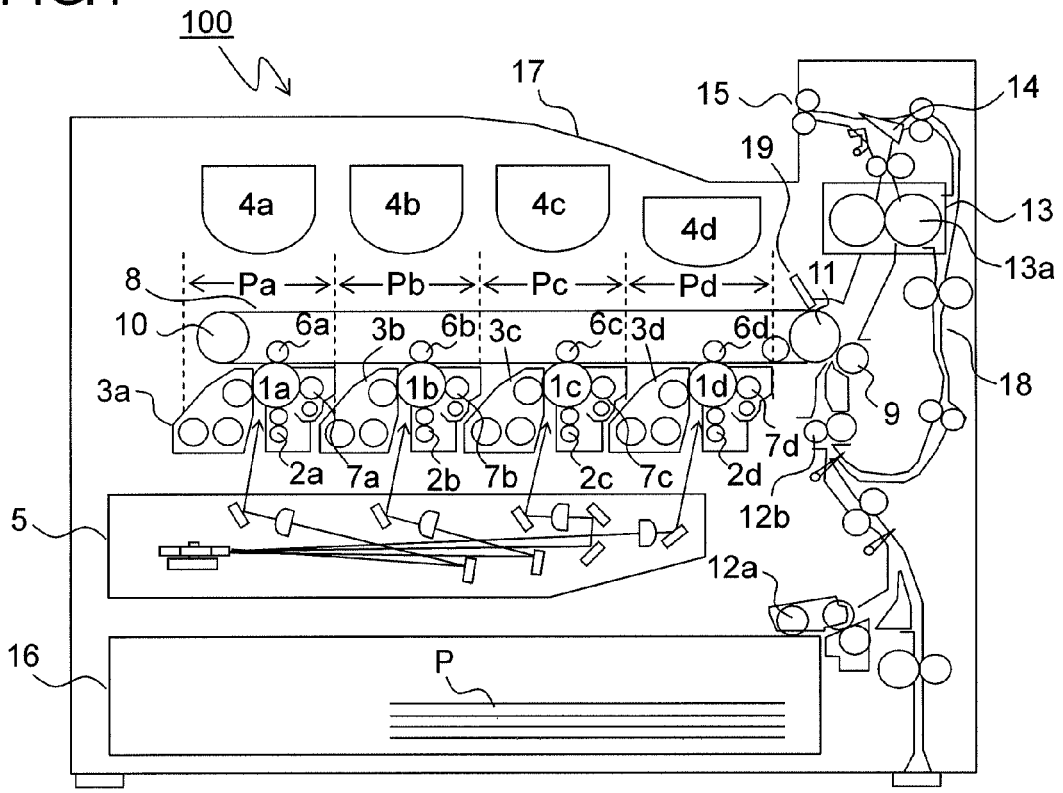
FIG. 1 is a schematic cross-sectional view showing an internal structure of an image forming apparatus 100 according to an embodiment of the present disclosure.

Hereinafter, embodiments of the present disclosure are described with reference to the drawings. FIG. 1 is a cross-sectional view showing a schematic structure of an image forming apparatus 100 according to an embodiment of the present disclosure. In the present embodiment, the image forming apparatus 100 is a color printer of tandem type in which four photosensitive drums 1*a*, 1*b*, 1*c* and 1*d* corresponding to four different colors (magenta, cyan, yellow, and black) are arranged in parallel with one another to perform image forming.

In an apparatus main boy of the image forming apparatus 100, four image forming portions Pa, Pb, Pc and Pd are disposed successively from a left side of FIG. 1. These image forming portions Pa-Pd are disposed correspondingly to images of the four different colors (magenta, cyan, yellow, and black) and form successively magenta, cyan, yellow and black images respectively through each step of electrification, light exposure, development and transfer.

These image forming portions Pa-Pd are respectively provided with the above photosensitive drums 1*a*-1*d* which carry visible images (toner images) of the respective colors, further, an intermediate transfer belt 8 rotating in a counterclockwise direction in FIG. 1 is disposed adjacently to each image forming portion Pa-Pd. The toner images formed on the photosensitive drums 1*a*-1*d* are successively transferred onto the intermediate belt 8 moving while butting each photosensitive drum 1*a*-1*d*. Thereafter, the toner images are transferred onto a paper sheet P by a secondary transfer roller 9 at a time, further, fixed onto the sheet P by a fixing device 13, thereafter, the sheet P is delivered from the image forming apparatus 100. An image forming process for each photosensitive drum 1*a*-1*d* is performed by rotating the photosensitive drums 1*a*-1*d* in a clockwise direction in FIG. 1.

The sheet P, on which the toner image is transferred, is stored in a sheet cassette 16 disposed in a lower portion of the image forming apparatus 100, and is conveyed to the secondary transfer roller 9 via a sheet feeding roller 12*a* and a registration roller pair 12*b*. A dielectric resin sheet is used for the intermediate transfer belt 8, mainly, a seamless belt is used. The intermediate transfer belt 8 and the secondary transfer roller 9 are driven and rotated by a belt drive motor (not shown) at the same linear velocity as the photosensitive drums 1*a*-1*d*. Besides, in a downstream side of the secondary transfer roller 9, a blade-shaped belt cleaner 19 for removing toner and the like remaining on a surface of the intermediate transfer belt 8 is disposed.

Next, the image forming portions Pa-Pd are described. Around and below the photosensitive drums 1*a*-1*d* disposed rotatably, there disposed are charging devices 2*a*, 2*b*, 2*c* and 2*d* that electrify the photosensitive drums 1*a*-1*d*, a light exposure unit 5 that applies light exposure to each photosensitive drum 1*a*-1*d* based on image data, developing devices 3*a*, 3*b*, 3*c* and 3*d* that develop electrostatic latent images formed on the photosensitive drums 1*a*-1*d* by using toner, and cleaning devices 7*a*, 7*b*, 7*c* and 7*d* that collect and remove developer (toner) remaining after the toner image is transferred onto the photosensitive drums 1*a*-1*d*.

When image data are input from an upward device such as a personal computer and the like, first, the charging devices 2*a*-2*d* electrify uniformly surfaces of the photosensitive drums 1*a*-1*d*. Thereafter, light is directed by the light exposure unit 5 to the surfaces of the photosensitive drums 1*a*-1*d* based on the image data to form an electrostatic latent image on each photosensitive drum 1*a*-1*d* in accordance with the image data. The developing devices 3*a*-3*d* each include a developing roller (developer carrier) which is disposed to oppose each photosensitive drum 1*a*-1*d* and is filled with a predetermined amount of two-component developer that contains toner of each color of magenta, cyan, yellow and black.

In the meantime, in a case where a percentage of the toner in the two-component developer packed in each developing device 3*a*-3*d* becomes lower than a specific value because of forming of a toner image described later, developer is supplied from containers 4*a*-4*d* to each developing device 3*a*-3*d*. The toner in the developer is supplied onto the photosensitive drums 1*a*-1*d* by the developing devices 3*a*-3*d* and electrically attached, whereby a toner image is formed corresponding to the electrostatic latent image formed by the light exposure of the light exposure unit 5.

And, primary transfer rollers 6*a*-6*d* apply a predetermined transfer voltage between the primary transfer rollers 6*a*-6*d* and the photosensitive drums 1*a*-1*d*. In this way, the magenta, cyan, yellow and black toner images on the photosensitive drums 1*a*-1*d* undergo primary transfer onto the intermediate transfer belt 8. These four color images are formed with a predetermined positional relationship defined beforehand for predetermined full-color image forming. The primary transfer rollers 6*a*-6*d* are driven and rotated by a primary transfer drive motor (not shown) at the same linear velocity as the photosensitive drums 1*a*-1*d* and the intermediate transfer belt 8. Thereafter, to prepare for forming of new electrostatic latent images performed successively, toner remaining on the surfaces of the photosensitive drums 1*a*-1*d* is removed by the cleaning devices 7*a*-7*d*.

The intermediate transfer belt 8 is mounted on a driven roller 10 and a drive roller 11. When the intermediate transfer belt 8 starts to rotate in the counterclockwise direction in accordance with rotation of the drive roller 11 by the above belt drive motor, the sheet P is conveyed at a predetermined timing from the registration roller pair 12*b* to a nip portion (secondary transfer nip portion) between the intermediate transfer belt 8 and the secondary transfer roller 9 disposed adjacently to the intermediate transfer belt 8, and a full-color image undergoes secondary transfer onto the sheet P at the nip portion. The sheet P, on which the toner image is transferred, is conveyed to the fixing device 13.

The sheet P conveyed to the fixing device 13 is heated and pressed when passing through a nip portion (fixing nip portion) between a fixing roller pair 13*a*, the toner image is fixed onto a surface of the sheet P, and a predetermined full-color image is formed. The sheet P, on which the full-color image is formed, is directed in a conveyance direction by a branch portion 14 that branches off into a plurality of directions. In a case of forming an image onto only one surface of the sheet P, the sheet P is delivered as it is to a discharge tray 17 by a discharge roller pair 15.

On the other hand, in a case of forming an image onto both surfaces of the sheet P, a portion of the sheet P passing through the fixing device 13 is temporarily protruded from the discharge roller pair 15 to an outside of the apparatus. Thereafter, the discharge roller pair 15 are rotated backward, the sheet P is directed in a reverse conveyance path 18 at the branch portion 14 and reconveyed to the secondary transfer roller 9 with the image surface reversed. And, the next image formed on the intermediate transfer belt 8 is transferred by the secondary transfer roller 9 onto a surface on which an image for the sheet P has not been formed yet, the sheet P is conveyed to the fixing device 13 to fix the toner image, and delivered to the discharge tray 17 by the discharge roller pair 15.

Figure 2:
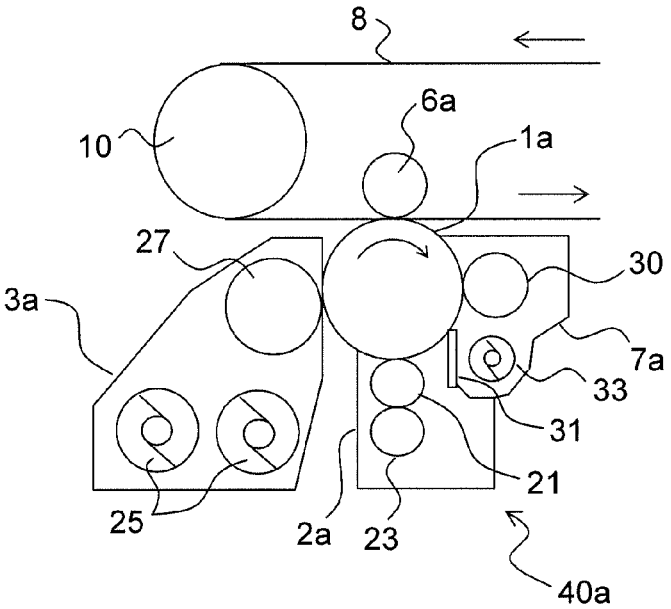
FIG. 2 is an enlarged cross-sectional view around an image forming portion Pa of FIG. 1.

Next, details of the above image forming portion Pa are described. In the meantime, the image forming portions Pd-Pd have basically the same structure as the image forming portion Pa; accordingly, its detailed description is skipped. FIG. 2 is an enlarged cross-sectional view around the image forming portion Pa of FIG. 1. The above charging device 2*a*, developing device 3*a*, primary transfer roller 6*a*, and cleaning device 7*a* are disposed around the photosensitive drum 1*a* along the drum rotation direction (clockwise direction of FIG. 2). Of these, the primary transfer roller 6*a* is disposed at a position that opposes the photosensitive drum 1*a* via the intermediate transfer belt 8.

Besides, the photosensitive drum 1*a*, the charging device 2*a*, and the cleaning device 7*a* are arranged into a unit. In the meantime, in the respective image forming portions Pa-Pd, the units composed of the photosensitive drums 1*a*-1*d*, charging devices 2*a*-2*d*, and cleaning devices 7*a*-7*d* are called drum units 40*a*-40*d* hereinafter.

The charging device 2*a* has a charging roller 21 that contacts the photosensitive drum 1*a* to apply an electrifying bias to a drum surface, and a charging cleaning roller 23 for cleaning the charging roller 21. The developing device 3*a* has: two stir conveyance members that include a stir conveyance screw 25*a* and a supply conveyance screw 25*b;* and a magnetic roller 27, makes two-component developer (magnetic brush) carried on a surface of the magnetic roller 27 contact a surface of the photosensitive drum 1*a* to develop an electrostatic latent image into a toner image.

The cleaning device 7*a* has a scrape roller (abrasive member) 30, a cleaning blade 31, and a collection spiral 33. The scrape roller 30 is pressed against the photosensitive drum 1*a* by a predetermined pressure, driven and rotated by a drum cleaning motor (not shown) in the same direction as the photosensitive drum 1*a* at the contact surface with the photosensitive drum 1*a*. A linear velocity of the scrape roller 30 is controlled to become faster (here, 1.2 times) than a linear velocity of the photosensitive drum 1*a*. As the scrape roller 30, there is a structure, for example, in which a foam layer, which is formed of EPDM rubber and has an Asker C hardness of 55°, is formed as a roller body around a metal shaft. A material of the roller body is not limited to the EPDM rubber, but rubber of another material or a foam rubber material may be used, and a material having a hardness in an Asker C hardness range of 10 to 90° is used preferably.

In the meantime, the Asker C is one of durometers (spring-type hardness meter) defined by the Society of Rubber Industry, Japan, that is, a measurement device for measuring a hardness. The Asker C hardness indicates a hardness measured by the above measurement device and represents that the larger a value is, the harder a material is.

The cleaning blade 31 is fixed in a state of being in contact with the photosensitive drum 1*a* in a more downstream side in the rotation direction than the contact surface of the photosensitive drum 1*a* with the scrape roller 30. As the cleaning blade 31, a blade, which has, for example, a JIS hardness of 78° and is formed of polyurethane rubber, is used and mounted at the contact point with a predetermined angle to a tangential direction of the photosensitive drum. In the meantime, as to the cleaning blade 31, a material, hardness, dimension, bite amount into the photosensitive drum 1*a*, pressing force and the like are suitably set in accordance with specifications of the photosensitive drum 1*a*. In the meantime, The JIS hardness indicates a hardness defined by Japanese Industrial Standards (JIS).

The remaining toner removed from the surface of the photosensitive drum 1*a* by the scrape roller 30 and the cleaning blade 31 is delivered to an outside of the cleaning device 7*a* (see FIG. 2) in accordance with rotation of the collection spiral 33. As the toner used in the present disclosure, there is toner in which abrasive selected from silica, titanium oxide, strontium titanate, alumina and the like is embedded in toner particle surfaces and protrudes partially from the toner surfaces or toner in which abrasive adheres to the toner surface electrostatically.

As described above, by rotating the scrape roller 30 with a velocity difference with respect to the photosensitive drum 1*a*, the surface of the photosensitive drum 1*a* is rubbed by the remaining toner containing the abrasive, and moisture, a discharge product and the like on the drum surface are removed along with the remaining toner by the scrape roller 30 and the cleaning blade 31.

In the meantime, a layout of the main body interior of the image forming apparatus 100 can be suitably changed if the rotation directions of the photosensitive drums 1*a*-1*d* and intermediate transfer belt 8 and the conveyance route of the sheet P can be suitably set. For example, it is also of course possible to set the rotation directions of the photosensitive drums 1*a*-1*d* and intermediate transfer belt 8 oppositely to the present embodiment, set the positional relationship between the drum units 40*a*-40*d* and the developing devices 3*a*-3*d* oppositely to the present embodiment, and set the conveyance route of the sheet P in accordance with the positional relationship oppositely set.

Figure 3:
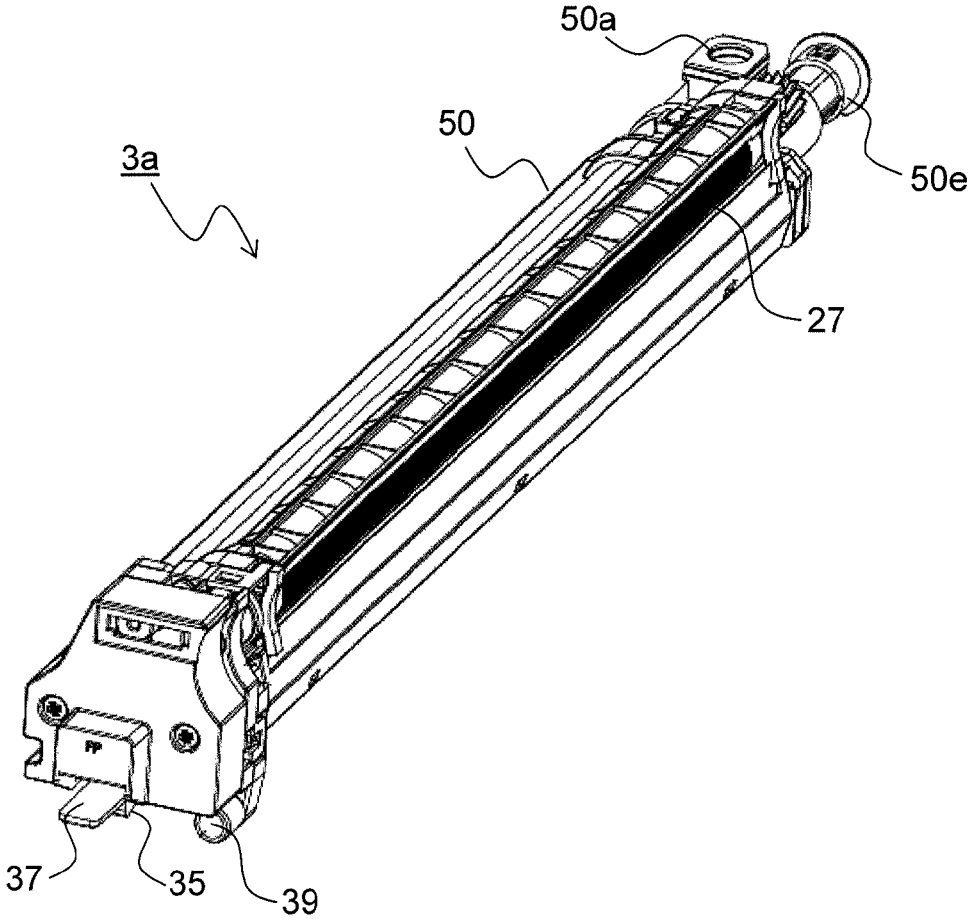
FIG. 3 is an appearance perspective view when seeing a developing device 3*a* mounted in the image forming apparatus 100 from an upstream side in an insertion direction into the image forming apparatus 100.

FIG. 3 is an appearance perspective view when seeing the developing device 3*a* mounted from an upstream side in an insertion direction into the image forming apparatus 100. In the meantime, the developing devices 3*b*-3*d* have basically the same structure as the developing device 3*a;* accordingly, description of them is skipped. The developing device 3*a* has the above stir conveyance screw 25*a*, supply conveyance screw 25*b* (see FIG. 2), magnetic roller 27 in a developing container 50, and a portion of an outer circumferential surface of the magnetic roller 27 is exposed from the developing container 50. The developing container 50 is provided with a developer supply aperture 50*a* that is connected to a developer supply path 106 (see FIG. 7) of a developing holder 105*a*. The developer containing corresponding color (here, magenta) toner is supplied into the developing device 3*a* via the developer supply aperture 50*a* and used for development of an electrostatic latent image. Besides, a rear side of the developing device 3*a* is provided with a developer delivery portion 50*e* that delivers surplus developer in the developing device 3*a*. The developer delivered from the developer delivery portion 50*e* is conveyed to a developer collection container (not shown) via a developer collection mechanism 110 (see FIG. 9). A detailed structure of the developer delivery portion 50*e* is described later.

A front side of the developing device 3*a* is provided with: an engagement claw 35 that engages with a unit support frame 103 (see FIG. 7) when the developing device 3*a* is inserted into the image forming apparatus 100; and a unlock lever 37 that unlocks the engagement of the engagement claw 35. The engagement claw 35 and the unlock lever 37 compose a lock mechanism that is able to hold the developing device 3*a* in a mounted state and unlock the holding. Bedsides, a right under portion of the front side of the developing device 3*a* is provided with a bearing portion 39 that rotatably fits to a first swing fulcrum 99*a* (see FIG. 7) of the unit support frame 103.

Figure 4:
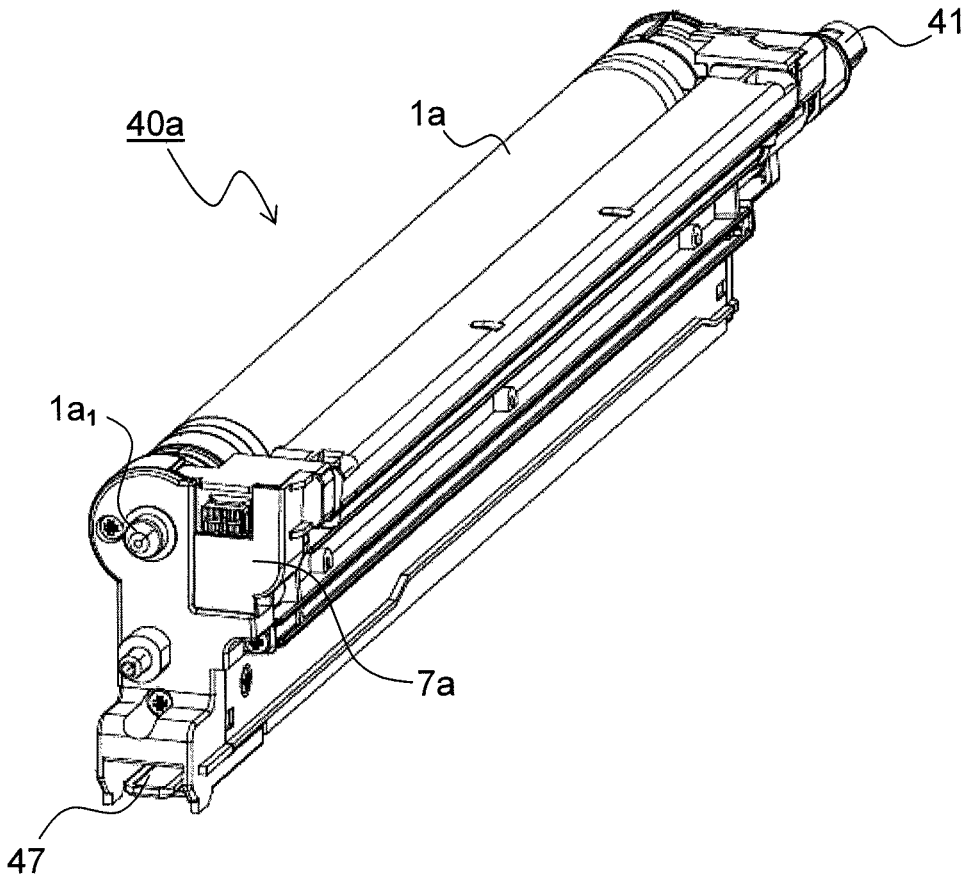
FIG. 4 is an appearance perspective view when seeing a drum unit 40*a* disposed adjacently to the developing device 3*a* from an upstream side in an insertion direction into the image forming apparatus 100.

FIG. 4 is an appearance perspective view when seeing the drum unit 40*a* disposed adjacently to the developing device 3*a* from an upstream side in an insertion direction into the image forming apparatus 100. In the meantime, the drum units 40*b*-40*d* have basically the same structure as the drum unit 40*a;* accordingly, description of them is skipped. A drum shaft $1a_1$, which is a rotary shaft of the photosensitive drum 1*a*, protrudes from a front surface and rear surface of the drum unit 40*a*. The drum shaft $1a_1$ protruding from the front surface of the drum unit 40*a* fits in a bearing hole 87*a* (see FIG. 8) of the retainer 85 that is disposed on an inner side of an open/close cover (not shown) on a front side of the image forming apparatus 100. On the other hand, the drum shaft $1a_1$ (not shown in FIG. 4) protruding from the rear surface of the drum unit 40*a* fits in a bearing hole of a rear side frame 102 (see FIG. 6) of the image forming apparatus 100.

The rear surface of the drum unit 40*a* is provided with a toner delivery portion 41 protruding continuously in a shaft direction of the collection spiral 33 (see FIG. 2). Wasted toner collected by the cleaning device 7*a* from the surface of the photosensitive drum 1*a* is delivered from the toner delivery portion 41 by the rotation of the collection spiral 33 and conveyed to the developer collection container (not shown) via the developer collection mechanism 110 (see FIG. 9).

Further, the front surface of the drum unit 40*a* is provided with: an engagement claw (not shown) that engages with the unit support frame 103 (see FIG. 7) when the drum unit 40*a* is inserted into the image forming apparatus 100; and a unlock lever 47 that unlocks the engagement of the engagement claw. The engagement claw and the unlock lever 47 compose a lock mechanism that is able to hold the drum unit 40*a* in a mounted state and unlock the holding.

Figure 5:
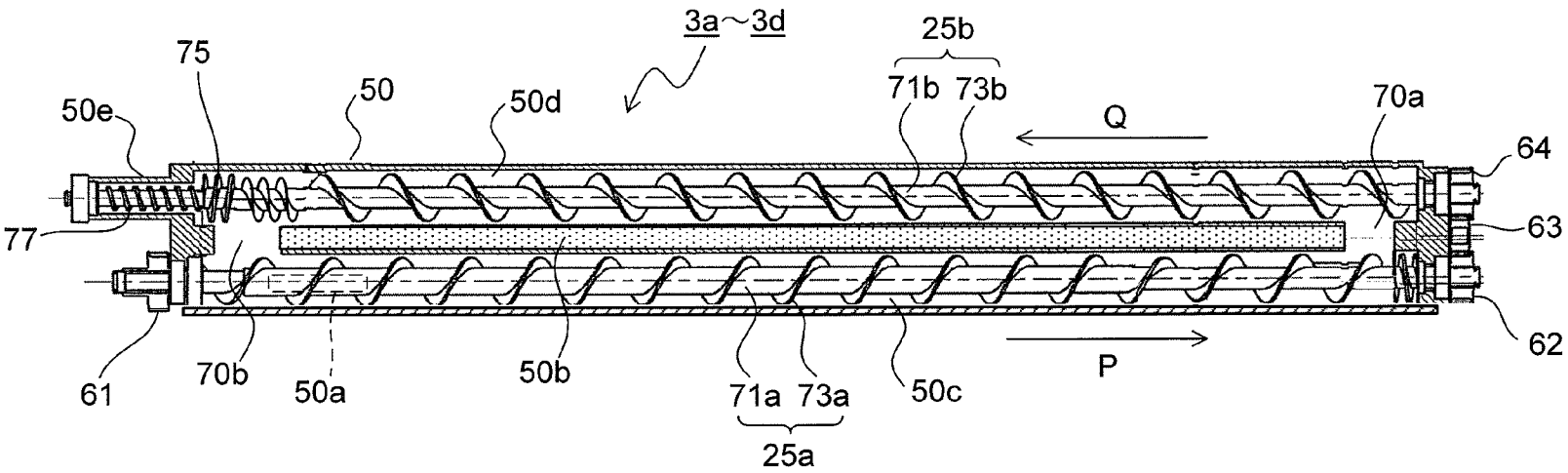
FIG. 5 is a plan cross-sectional view showing stirring portions of the developing devices 3*a*-3*d*.

Next, stirring portions of the developing devices 3*a*-3*d* are described in detail. FIG. 5 is a plan cross-sectional view showing the stirring portions of the developing devices 3*a*-3*d*. A stir conveyance chamber 50*c*, a supply conveyance chamber 50*d*, and developer paths 70*a*, 70*b* are formed by a partition wall 50*b* in an inside of the developing container 50, besides, the developer supply aperture 50*a* and the developer delivery portion 50*e* are formed. In the meantime, as to the stir conveyance chamber 50*c*, a left side of FIG. 5 is called an upstream side, a right side of FIG. 5 is called a downstream side, besides, as to the supply conveyance chamber 50*d*, the right side of FIG. 5 is called an upstream side, and the left side of FIG. 5 is called a downstream side. Accordingly, the developer paths 70*a*, 70*b* are called the upstream side and the downstream side respectively with respect to the supply conveyance chamber 50*d*.

The partition wall 50*b* extends in a longitudinal direction of the developing container 50 and partitions the stir conveyance chamber 50*c* and the supply conveyance chamber 50*d* to arrange them in parallel with each other. A right end portion in a longitudinal direction of the partition wall 50*b* collaborates with an inner wall of the developing container 50 to form the developer path 70*a* in the upstream side. On the other hand, a left end portion in the longitudinal direction of the partition wall 50*b* collaborates with the inner wall of the developing container 50 to form the developer path 70*b* in the downstream side. And, the developer is able to circulate in the stir conveyance chamber 50*c*, the developer path 70*a*, the supply conveyance chamber 50*d*, and the developer path 70*b*.

The developer supply aperture 50*a* is an aperture for supplying new developer into the developing container 50 from the containers 4*a*-4*d* (see FIG. 1) disposed in an upper portion of the developing container 50 via the developer supply path 106 (see FIG. 7) of the developing holder 105*a*, and is disposed in the upstream side (left side of FIG. 5) of the stir conveyance chamber 50*c*.

The developer delivery portion 50*e* is an aperture for delivering developer that becomes surplus in the stir conveyance chamber 50*c* and the supply conveyance chamber 50*d* because of developer supply, and is disposed continuously in the downstream side of the supply conveyance chamber 50*d* in the longitudinal direction of the supply conveyance chamber 50*d*.

The stir conveyance screw 25*a* is disposed in the stir conveyance chamber 50*c*, and the supply conveyance screw 25*b* is disposed in the supply conveyance chamber 50*d*. The stir conveyance screw 25*a* has a rotary shaft 71*a*, and a spiral blade 73*a* that is integrally disposed with the rotary shaft 71*a* and formed spirally in a shaft direction of the rotary shaft 71*a* at a constant pitch. The supply conveyance screw 25*b* has a rotary shaft 71*b*, and a spiral blade 73*b* that is integrally disposed with the rotary shaft 71*b* and formed spirally in a shaft direction of the rotary shaft 71*b* at a constant pitch. Besides, the spiral blade 73*b* of the supply conveyance screw 25*b* is formed of a blade that has the same pitch as the spiral blade 73*a* of the stir conveyance screw 25*a* and is directed in an opposite direction (opposite phase). The rotary shaft 71*a* of the stir conveyance screw 25*a* and the rotary shaft 71*b* of the supply conveyance screw 25*b* are rotatably supported by wall portions of both end sides in the longitudinal direction of the developing container 50.

Besides, the rotary shaft 71*b* of the supply conveyance screw 25*b* is integrally provide with a limit portion 75 and a delivery blade 77 along with the spiral blade 73*b*.

The limit portion 75 blocks the developer conveyed to the downstream side in the supply conveyance chamber 50*d* and conveys a predetermined amount of developer or more to the developer delivery portion 50*e*. The limit portion 75 is spirally formed of a blade that is directed in a direction opposite (opposite phase) to the spiral blade 43*b*, has substantially the same outer diameter as the outer diameter of the spiral blade 73*b*, and is set smaller than the spiral blade 73*b* in pitch. Besides, a predetermined size of gap is formed between the inner wall portion of the developing container 50 and an outer circumferential edge of the limit portion 75. The surplus developer is delivered from the gap to the developer delivery portion 50*e*.

The rotary shaft 71*b* extends into the developer delivery portion 50*e*. The rotary shaft 71*b* in the developer delivery portion 50*e* is provided with the delivery blade 77. The delivery blade 77 includes a spiral blade directed in the same direction as the spiral blade 73*b*, is smaller than the spiral blade 73*b* in pitch, and an outer diameter of the blade is smaller than the spiral blade 73*b*. Accordingly, when the rotary shaft 71*b* rotates, also the delivery blade 77 rotates, and the surplus developer, which goes over the limit portion 75 to be conveyed into the developer delivery portion 50*e*, is sent to a left side of FIG. 5 and delivered to an outside of the developing container 50. In the meantime, the delivery blade 77, the limit portion 75, and the spiral blade 73*b* are formed of synthetic resin integrally with the rotary shaft 71*b*.

An outer wall of the developing container 50 is provided with gears 61-64. The gears 61, 62 are fixed to the rotary shaft 71*a*, the gear 64 is fixed to the rotary shaft 71*b*, the gear 63 is rotatably held by the developing container 50 and meshes with the gears 62, 64.

During a developing period when new developer is not supplied, when the gear 61 is rotated by a drive source such as a motor and the like, the stir conveyance screw 25*a* rotates, the developer in the stir conveyance chamber 50*c* is conveyed in an arrow P direction and conveyed into the supply conveyance chamber 50*d* through the developer path 70*a*. Further, drive force of the stir conveyance screw 25*a* is transmitted to the supply conveyance screw 25*b* via the gears 62-64, and when the supply conveyance screw 25*b* rotates, the developer in the supply conveyance chamber 50*d* is conveyed in an arrow Q direction. Accordingly, the developer, changing dramatically its height level, is conveyed from the stir conveyance chamber 50*c* into the supply conveyance chamber 50*d* through the developer path 70*a* in the upstream side, does not go over the limit portion 75, and is conveyed into the stir conveyance chamber 50*c* through the developer path 70*b* in the downstream side.

As described above, the developer is circulated from the stir conveyance chamber 50*c* through the developer path 70*a*, the supply conveyance chamber 50*d*, and the developer path 70*b* while being stirred, and the stirred developer is supplied to the magnetic roller 27 (see FIG. 2).

Next, a case where new developer is supplied from the developer supply aperture 50*a* is described. When the toner is consumed by development, carrier-containing developer is supplied from the developer supply aperture 50*a* into the stir conveyance chamber 50*c*.

In the same way as during the developing period, the supplied developer is conveyed in the stir conveyance chamber 50*c* by the stir conveyance screw 25*a* in the arrow P direction, thereafter, conveyed into the supply conveyance chamber 50*d* through the developer path 70*a* in the upstream side. Further, the developer in the supply conveyance chamber 50*d* is conveyed in the arrow Q direction by the supply conveyance screw 25*b*. When the limit portion 75 rotates in accordance with rotation of the supply conveyance screw 25*b*, conveyance force in a direction opposite to the developer conveyance direction (arrow Q direction) of the spiral blade 73*b* is given to the developer. The developer is blocked by the limit portion 75 to have the high height level, the surplus developer goes over the limit portion 75 and is delivered to the outside of the developing container 50 via the developer delivery portion 50*e*.

Figure 6:
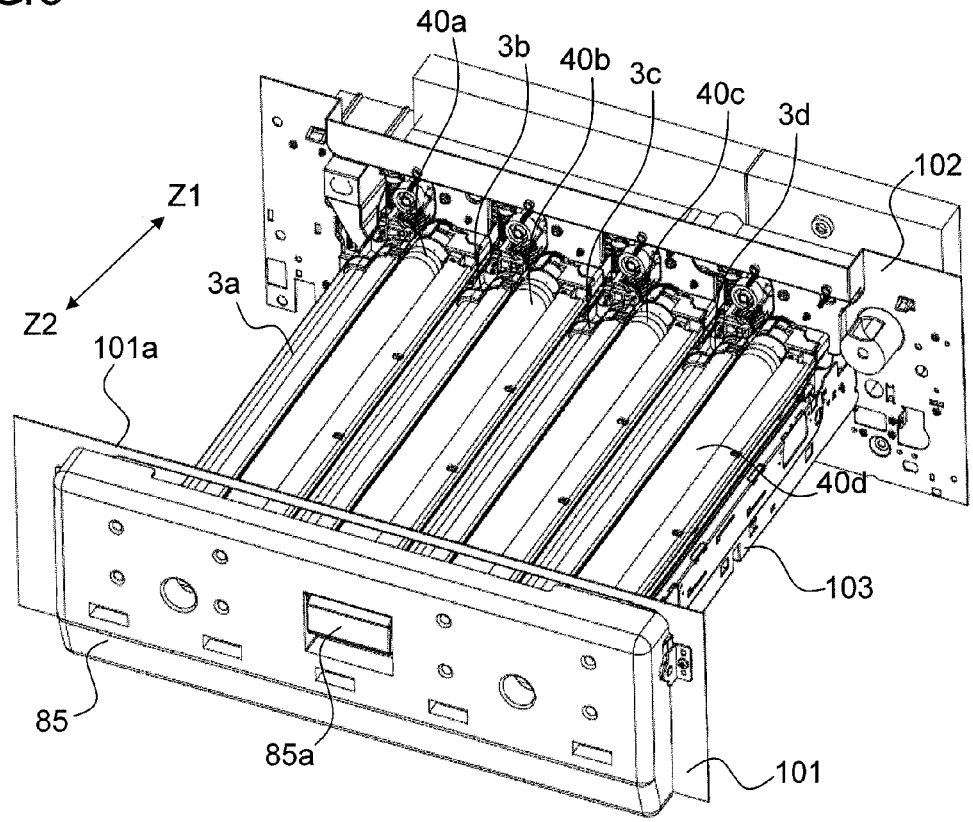
FIG. 6 is a perspective view showing a state in which the developing devices 3*a*-3*d* and the drum units 40*a*-40*d* are mounted in the image forming apparatus 100 according to a first embodiment of the present disclosure.
Figure 7:
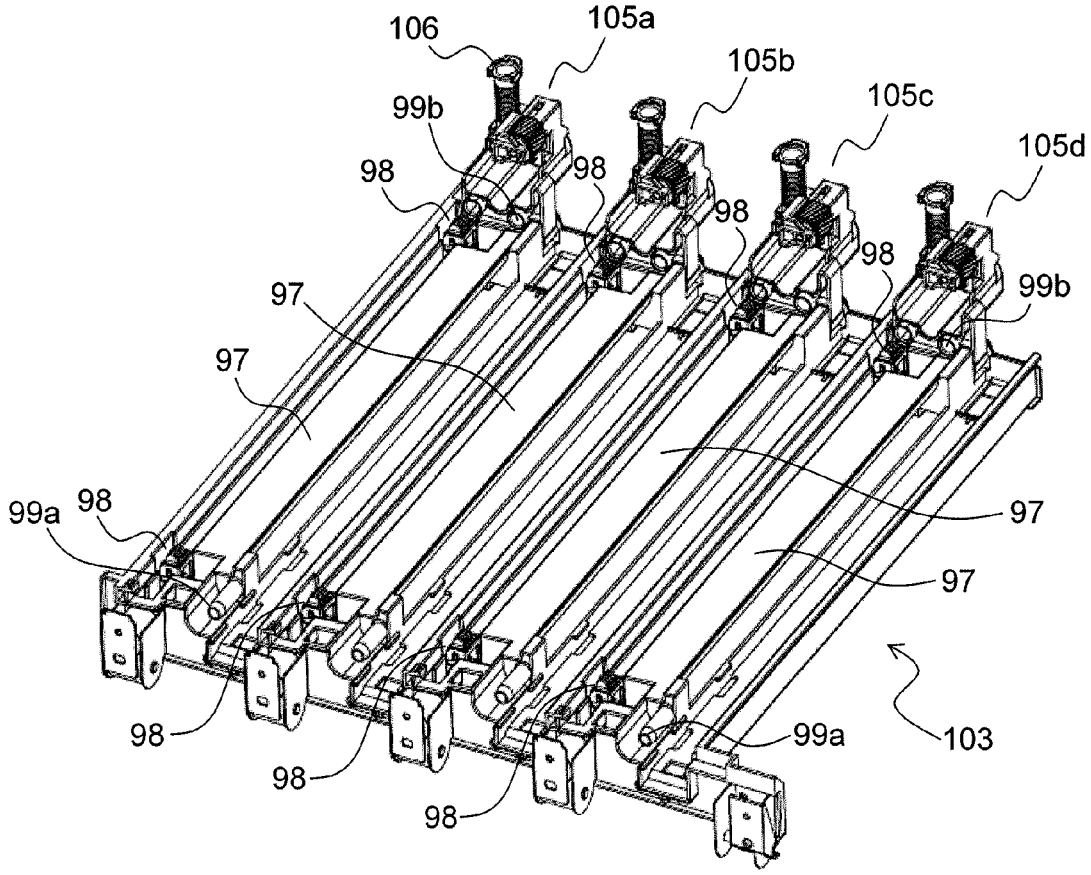
FIG. 7 is a perspective view of a unit support frame 103 that supports the developing devices 3*a*-3*d* and drum units 40*a*-40*d* used for the image forming apparatus 100 according to the first embodiment.
Figure 8:
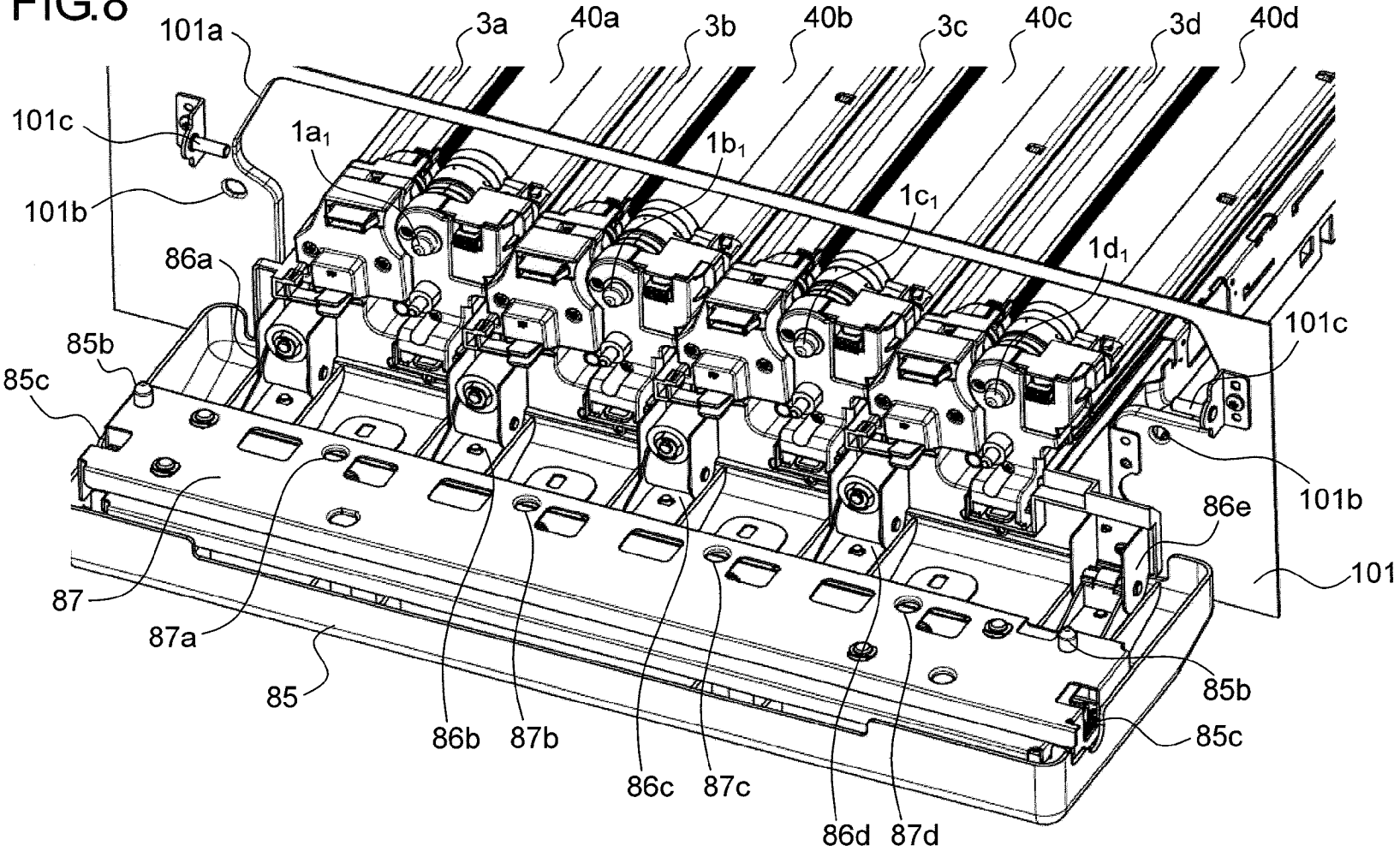
FIG. 8 is an enlarged perspective view of connection portions between the developing devices 3*a*-3*d* and a retainer 85 and connection portions between the drum units 40*a*-40*d* and the retainer 85 in the image forming apparatus 100 according to the first embodiment.

FIG. 6 is a perspective view showing a state in which the developing devices 3*a*-3*d* and the drum units 40*a*-40*d* are mounted in the image forming apparatus 100 according to the first embodiment of the present disclosure, FIG. 7 is a perspective view of the unit support frame 103 that supports the developing devices 3*a*-3*d* and drum units 40*a*-40*d* used for the image forming apparatus 100 according to the first embodiment, and FIG. 8 is an enlarged perspective view of connection portions between the developing devices 3*a*-3*d* and the retainer 85 and connection portions between the drum units 40*a*-40*d* and the retainer 85 in a state in which the retainer 85 is opened in the image forming apparatus 100 according to the first embodiment.

The developing devices 3*a*-3*d* and the drum units 40*a*-40*d* are supported in a mountable/demountable manner by the unit support frame 103 that is connected to the front side frame 101 and the rear side frame 102 like a bridge. Hereinafter, a direction (arrow Z1 direction), in which the developing devices 3*a*-3*d* and the drum units 40*a*-40*d* are mounted in the image forming apparatus 100 main body, is called a first direction, and a direction (arrow Z2 direction), in which the developing devices 3*a*-3*d* and the drum units 40*a*-40*d* are drawn out from the image forming apparatus 100 main body, is called a second direction.

The retainer 85 is supported swingably in an up and down direction with respect to the front side frame 101 by hinge portions 86*a*-86*e* that are disposed in a lower portion and used as fulcrums, opens and closes an aperture portion 101*a* formed through the front side frame 101. The retainer 85 holds a positioning plate 87 that performs positioning of one end of each drum shaft $1a_1$, $1b_1$, $1c_1$, and $1d_1$. By rotating the retainer 85 on the hinge portions 86*a*-86*e* used as the fulcrums, the drum shafts $1a_1$, $1b_1$, $1c_1$, and $1d$, are relatively inserted into and drawn out from the bearing holes 87*a*-87*d* of the positioning plate 87.

A handle portion 85*a* is disposed at a central portion of the front side of the retainer 85, and positioning convex portions 85*b* are disposed at both end portions of the rear side of the retainer 85. The positioning convex portion 85*b* is fitted into a positioning hole 101*b* of the front side frame 101 to perform positioning of the retainer 85 with respect to the image forming apparatus 100 main body.

Lock pins 101*c* are disposed near the aperture portion 101*a* of the front side frame 101. The lock pins 101*c* are engagement members that engage with hooks 89 (see FIG. 11) in engagement hole portions 85*c* disposed at both ends of the retainer 85. The hook 89 is biased by a not-shown spring in a swing direction to engage with the lock pin 101*c*. In the meantime, a rotary shaft 89*a* (see FIG. 11) to which the hook 89 is fixed is disposed in parallel with a swing shaft (shaft passing through the hinge portions 86*a*-86*e*) of the retainer 85.

The handle portion 85*a* is disposed to associate with the rotary shaft 89*a* of the hook 89. By gripping the handle portion 85*a*, the shaft 89*a* rotates, the hook 89 swings, the engagement between the hook 89 and the lock pin 101*c* is unlocked, and the retainer 85 becomes swingable.

The unit support frame 103 is provided with four rest portions 97, which support bottom surfaces of the developing devices 3*a*-3*d*, along a forward and backward direction (arrows Z1-Z2 direction) of the image forming apparatus 100. Bedsides, a roller contact-separation cam 98 is disposed which moves up and down one end (left end of FIG. 7) of each developing device 3*a*-3*d* in a direction perpendicular to a longitudinal direction of each developing device 3*a*-3*d* supported by each rest portion 97. A pair of the roller contact-separation cams 98 are disposed at two positions of each rest portion 97 in the forward and backward direction of the image forming apparatus 100. The pair of roller contact-separation cams 98 are connected to a cam shaft (not shown) to rotate at the same time and in the same direction.

Besides, the unit support frame 103 is provided with: the first swing fulcrums 99*a* with which the bearing portions 39 formed at front end portions (end portions in the upstream side in the insertion direction into the image forming apparatus 100) of the developing devices 3*a*-3*d* engage; and the developing holders 105*a*-105*d* connected to rear end portions (end portions in the downstream side in the insertion direction into the image forming apparatus 100) of the developing devices 3*a*-3*d*. The developing holders 105*a*-105*d* are swingably supported by the unit support frame 103 at second swing fulcrums 99*b*. According to this structure, each developing device 3*a*-3*d* connected to each developing holder 105-105*d* is swingable, in accordance with swing of the roller contact-separation roller 98, together with the developing holders 105*a*-105*d* on the first swing fulcrums 99*a* disposed at one end (left end of FIG. 7) in a direction perpendicular to the longitudinal direction and on the second swing fulcrums 99*b*.

The developing holders 105*a*-105*d* are each provided with the developer supply path 106 that supplies the developer from the containers 4*a*-4*d* (see FIG. 1) to the developing devices 3*a*-3*d*, and guide holes (not shown) that guide the developer delivery portions 50*e* of the developing devices 3*a*-d3 to second connection portions 111*b* (see FIG. 9) of the developer collection mechanism 110.

Figure 9:
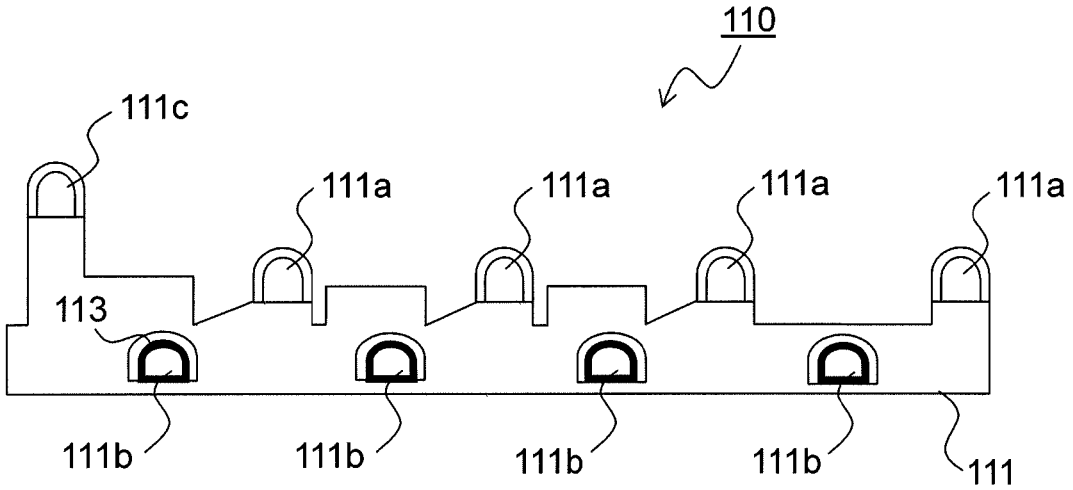
FIG. 9 is a front view of a developer collection mechanism 110 to which the developing devices 3*a*-3*d* and the drum units 40*a*-40*d* are connected.

FIG. 9 is a front view of the developer collection mechanism 110 to which the developing devices 3*a*-3*d* and the drum units 40*a*-40*d* are connected. The developer collection mechanism 110 has a conveyance route 111 in which a conveyance screw (not shown) is disposed and a developer collection container (not shown) which stores developer conveyed via the conveyance path 111. Besides, the conveyance route 111 is provided with four first connection portions 111*a* to which the toner delivery portions 41 (see FIG. 4) of the respective drum units 40*a*-40*d* are connected, four second connection portions 111*b* to which the developer delivery portions 50*e* (see FIG. 3, FIG. 5) of the respective developing devices 3*a*-3*d* are connected, and a third connection portion 111*c* connected to the developer collection container. The developer collection mechanism 110 is supported by the rear side frame 102 (see FIG. 6) that is disposed oppositely to the front side frame 101 via each developing device 3*a*-3*d* and each drum unit 40*a*-40*d*.

In the state of FIG. 6 in which the developing devices 3*a*-3*d* and the drum units 40*a*-40*d* are mounted in the image forming apparatus 100, the toner delivery portions 41 of the drum units 40*a*-40*d* are connected to the first connection portions 111*a* of the developer collection mechanism 110. Besides, the developer delivery portions 50*e* of the developing devices 3*a*-3*da* are connected to the second connection portions 111*b* of the developer collection mechanism 110.

Here, a shutter member (not shown) disposed on the toner delivery portion 41 is pressed by the first connection portion 111*a* to move, and a toner delivery aperture (not shown) is opened in the first connection portion 111*a*. Besides, a shutter member (not shown) disposed on the developer delivery portion 50*e* is pressed by the second connection portion 111*b* to move, and a developer delivery aperture (not shown) is opened in the second connection portion 111*b*.

Besides, considering the swing at mounting and demounting times of the developing devices 3*a*-3*d* described later, an inner diameter of the second connection portion 111*b* is formed larger than an outer diameter of the developer delivery portion 50*e*, and an inner circumferential surface of the second connection portion 111*b* is provided with a seal member 113. In this way, when the developing devices 3*a*-3*d* swing together with the developing holders 105*a*-105*d*, a load does not act on the second connection portion 111*b* and the developer delivery portion 50*e*, besides, it is possible to prevent developer leak from the second connection portion 111*b*.

Figure 10:
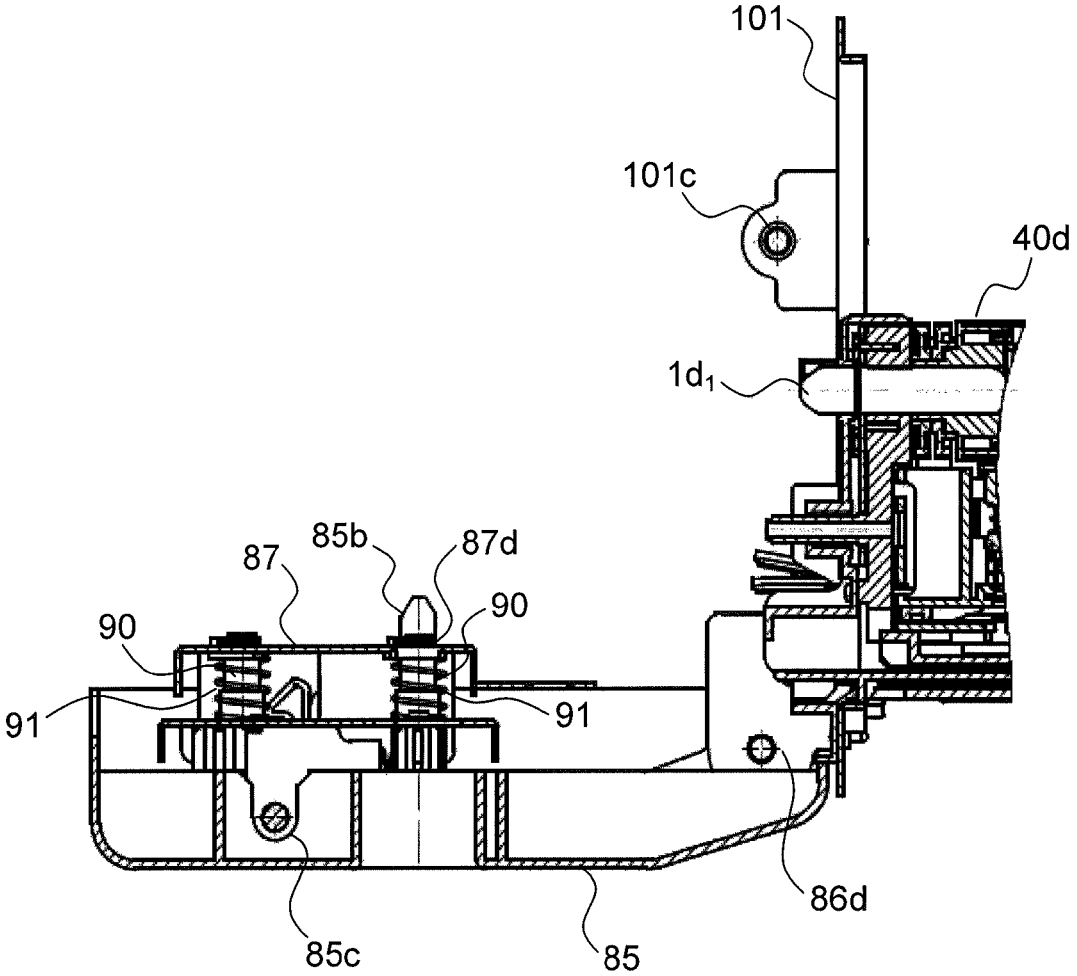
FIG. 10 is a side cross-sectional view of the retainer 85 and drum unit 40*d* in a state in which the retainer 85 opens an aperture portion 101*a* in the image forming apparatus 100 according to the first embodiment.
Figure 11:
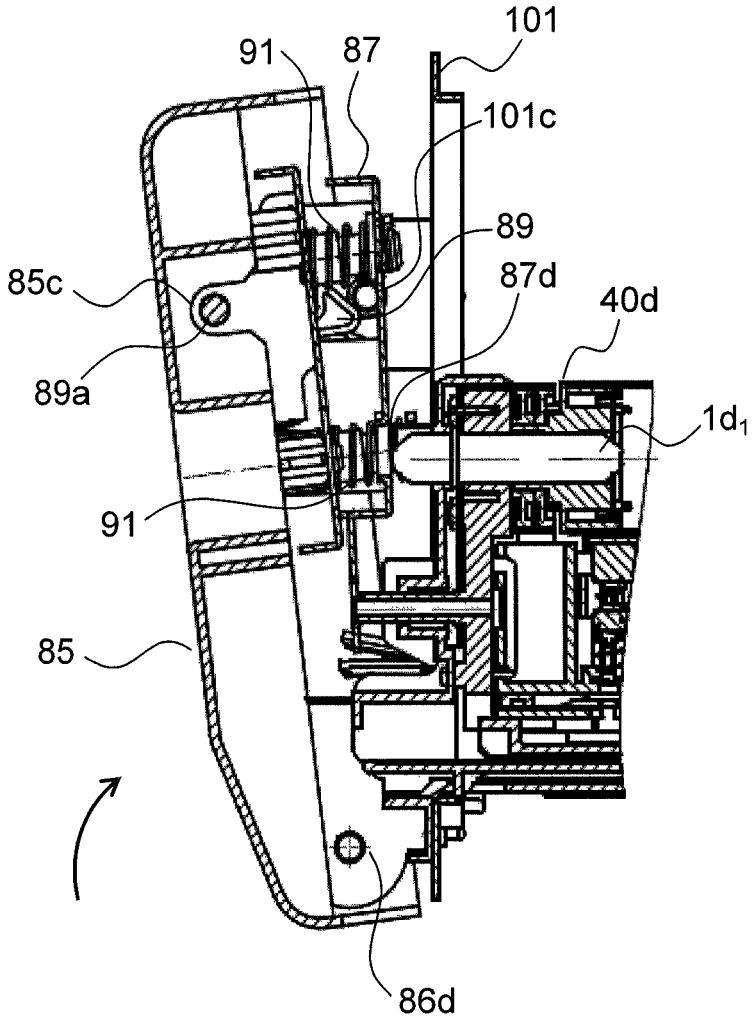
FIG. 11 is a side cross-sectional view showing a state in which the retainer 85 swings in a closing direction from the state of FIG. 10 and a positioning plate 87 butts a drum shaft $1d_1$.
Figure 12:
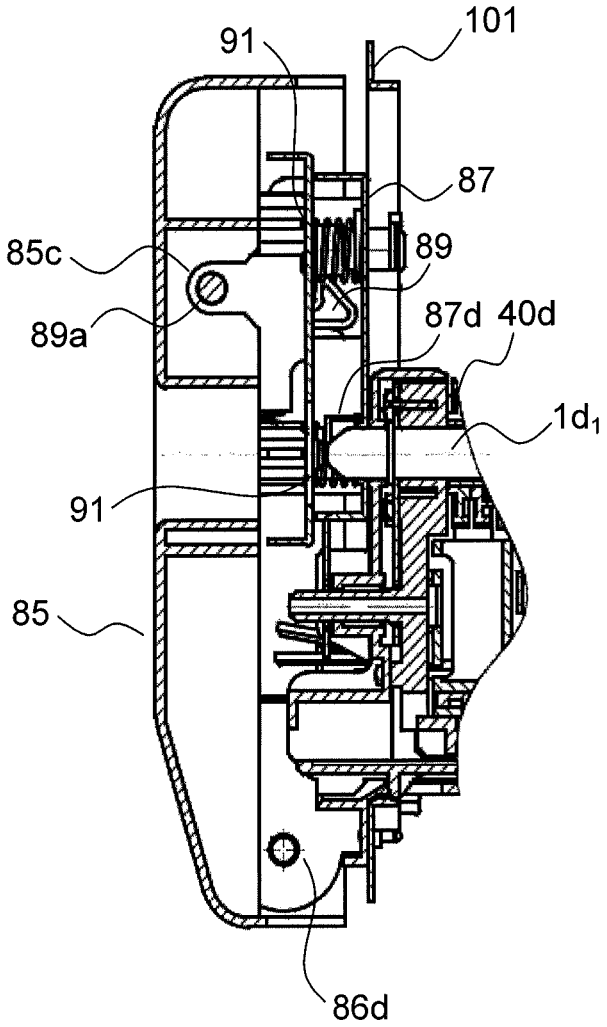
FIG. 12 is a side cross-sectional view of the retainer 85 and drum unit 40*d* in a state in which the retainer 85 closes the aperture portion 101*a* in the image forming apparatus 100 according to the first embodiment.
Figure 13:
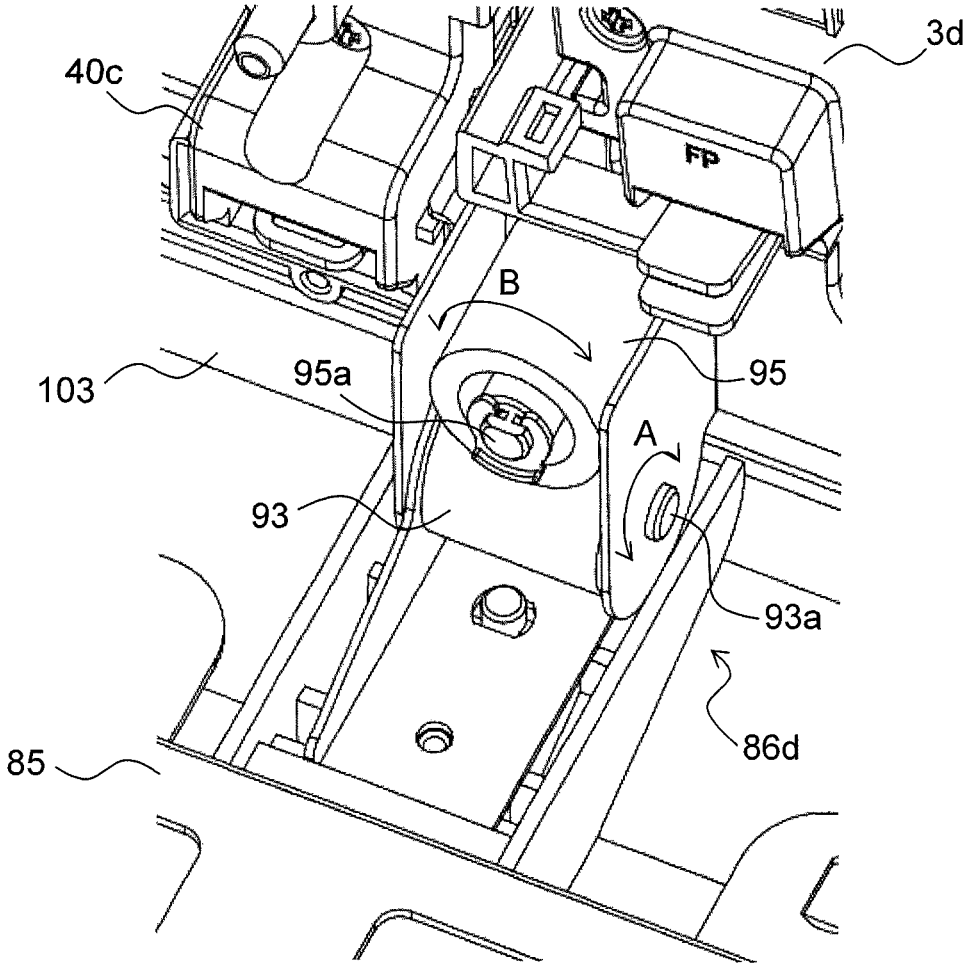
FIG. 13 is an enlarged view around a hinge portion 86*d* of FIG. 8.
Figure 14:
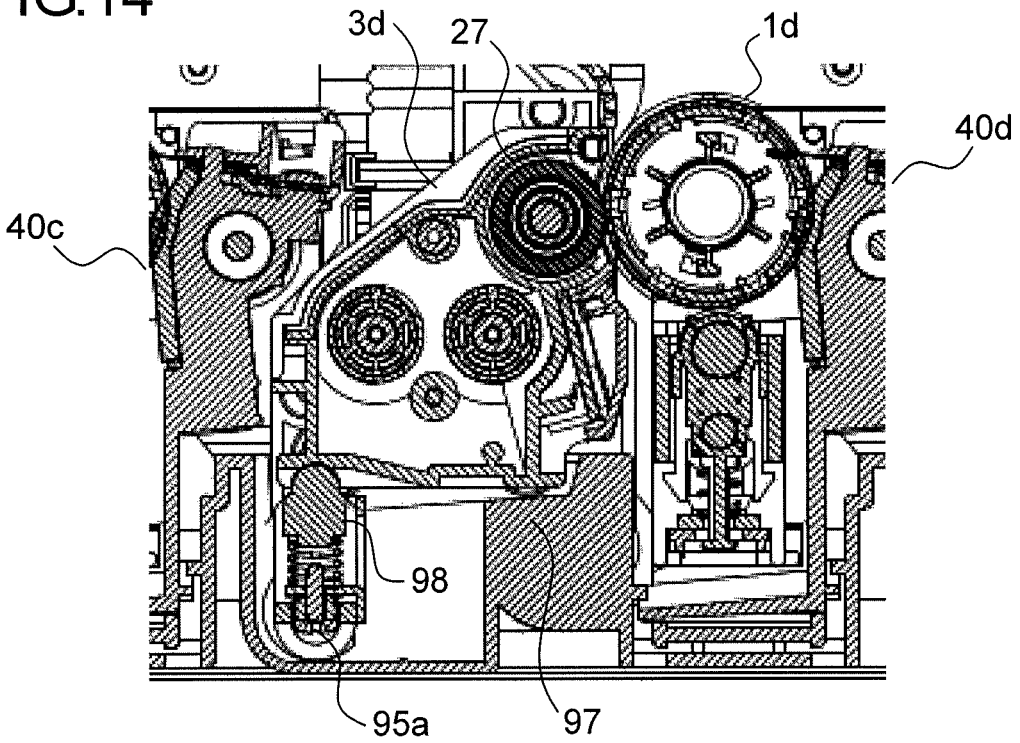
FIG. 14 is a front cross-sectional view of the developing device 3*d* and drum unit 40*d* when the retainer 85 is in the state to close the aperture portion 101*a* in the image forming apparatus 100 according to the first embodiment.
Figure 15:
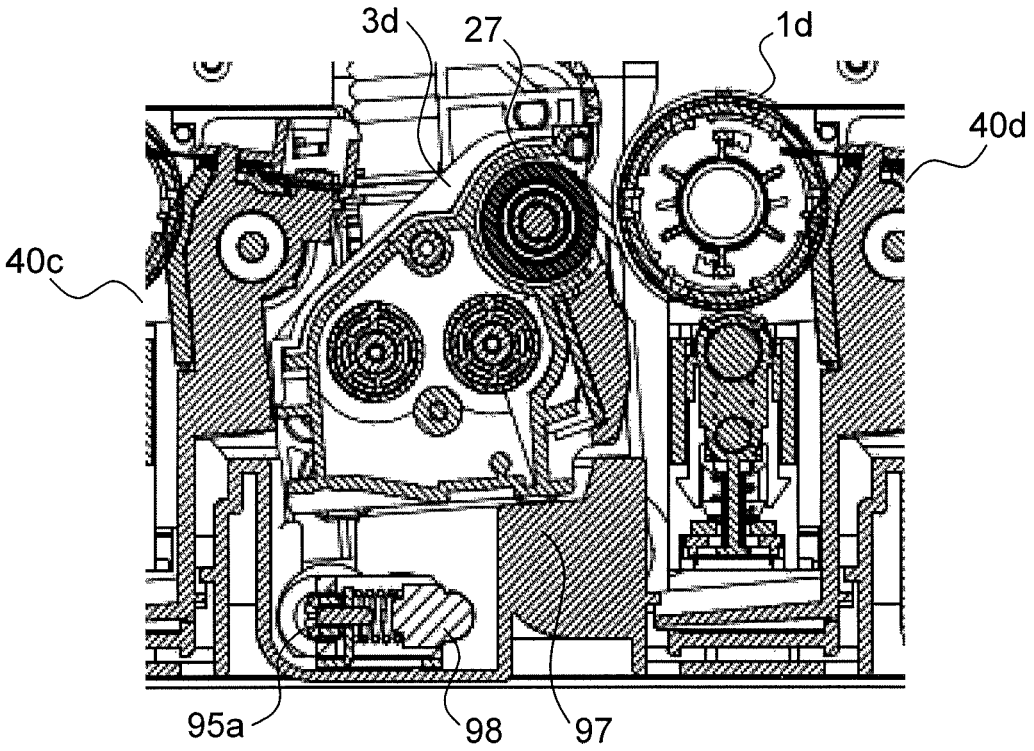
FIG. 15 is a front cross-sectional view of the developing device 3*d* and drum unit 40*d* when the retainer 85 is in the state to open the aperture portion 101*a* in the image forming apparatus 100 according to the first embodiment.

FIG. 10-FIG. 12 are each a side cross-sectional view of the retainer 85 and drum unit 40*d* from a state in which the retainer 85 opens the aperture portion 101*a* to a state in which the retainer 85 closes the aperture portion 101*a* in the image forming apparatus 100 according to the first embodiment, FIG. 13 is an enlarged view around the hinge portion 86*d* of FIG. 7, FIG. 14 and FIG. 15 are each a front cross-sectional view of the developing device 3*d* and drum unit 40*d* when the retainer 85 is in the state to close the aperture portion 101*a* and in the state to open the aperture portion 101*a*.

As shown in FIG. 10, the rear side (side where the positioning plate 87 is mounted) of the retainer 85 is provided with a plurality of coil springs 90 and a guide pin 91 inserted into the coil spring 90. A predetermined gap (play) is disposed between the positioning plate 87 and the guide pin 91, and a tip end of the guide pin 91 is provided with a lock member (not shown) that prevents coming-off of the positioning plate 87. In other words, the positioning plate 87 is held swingably in a direction to come close to or go away from the retainer 85 along the guide pin 91.

Besides, the positioning plate 87 is biased by the coil spring 90 in the direction (upward direction of FIG. 10) to go away from the retainer 85. In the meantime, if it is possible to bias the positioning plate 87 in the direction in which the positioning plate 87 goes away from the retainer 85, the coil spring 90 is not limiting, but for example, a plate spring may be used or a rubber-like elastic member may be used.

According to the above structure, the positioning plate 87 is held by the retainer 85 in a somewhat displaceable state. In other words, the positioning plate 87 is not fully fixed by the retainer 85, but is held by the retainer 85 in such a manner that a little deviation (displacement) occurs. In the meantime, the displacement of the positioning plate 87 includes translation of the positioning plate 87 with respect to the drum shaft $1d_1$ and change in inclination of the positioning plate 87 with respect to the drum shaft $1d_1$.

As shown in FIG. 13, the hinge portion 86*d* is provided with a first gear 93 and a second gear 95 that meshes with the first gear 93. The first gear 93 and the second gear 95 are each a helical gear that is provided with 45°-gear teeth, and the second gear 95 meshes with the first gear 93 in a direction in which the rotary shafts are perpendicular to each other. In the meantime, instead of the helical gear, it is also possible to compose the first gear 93 and the second gear 95 by using bevel gears which mesh with each other in a direction in which the rotary shafts are perpendicular to each other.

In accordance with the swing of the retainer 85, the first gear 93 swings on a rotary shaft 93*a* in a swing direction (arrow A direction) of the retainer 85. The second gear 95 rotates on a rotary shaft 95*a* in a direction (arrow B direction) perpendicular to the rotation direction of the first gear 93.

Besides, as shown in FIG. 14, the rotary shaft 95*a* of the second gear 95 is provided with the roller contact-separation cam 98. In the state of FIG. 7 in which the retainer 85 is closed, the developing device 3*d* is supported, by the roller contact-separation cam 98 and the rest portion 97 of the unit support frame 103, at two positions of a bottom surface of the developing container 50 when seeing from a shaft direction of the magnetic roller 27. Here, the magnetic roller 27 is held in a state of being close to the photosensitive drum 1*d* of the drum unit 40*d*.

Next, referring to FIG. 1-FIG. 8 when necessary, operations of mounting and demounting the developing devices 3*a*-3*d* and the drum units 40*a*-40*d* in and from image forming apparatus 100 according to the first embodiment are described by using FIG. 10-FIG. 12. In the meantime, FIG. 10-FIG. 12 each show a cross section passing through the drum shaft 1*d*, of the drum unit 40*d*, and the operations of mounting and demounting the developing device 3*d* and the drum unit 40*d* are described as examples. However, the operations of mounting and demounting the developing devices 3*a*-3*c* and the drum units 40*a*-40*c* are quite the same; accordingly, description of then is skipped.

In a case of removing the developing device 3*d* and the drum unit 40*d* from the image forming apparatus 100 main body, first, a not-shown front cover of the image forming apparatus 100 main body is opened, thereafter, in the state of FIG. 7, the handle portion 85*a* is gripped to unlock the engagement between the hook 89 and the lock pin 101*c*, and the retainer 85 is swung in the downward direction (opened direction). In this way, the fitting of the drum shafts $1a_1$-$1d_1$ in the bearing holes 87*a*-87*d* and the fitting of the positioning convex portion 85*b* in the positioning hole 101*b* of the front side frame 101 are unlocked. And, as shown in FIG. 8, the aperture portion 101*a* of the front side frame 101 is opened, and the developing devices 3*a*-3*d* and the drum units 40*a*-40*d* become accessible.

Besides, also the first gear 93 and the second gear 95 swing in the predetermined direction in accordance with the swing of the retainer 85; accordingly, also the roller contact-separation cam 98 provided on the rotary shaft 95*a* of the second gear 95 swings from an elevated state shown in FIG. 14 to a horizontal state shown in FIG. 15. As a result of this, the developing device 3*d* goes to a state of being supported by the rest portion 97 at only one position of the bottom surface of the developing container 50 when seeing from the shaft direction of the magnetic roller 27. And, the developing device 3*d* swings in a counterclockwise direction on the front side first swing fulcrum 99*a* and the rear side second swing fulcrum 99*b* (see FIG. 7) provided on the developing holder 105*d*. In this way, the developing device 3*d* is disposed at a position (separation position) where the magnetic roller 27 is evacuated from the photosensitive drum 1*d*.

As described above, by only opening the retainer 85, it is possible to evacuate the magnetic roller 27 of the developing device 3*d* from the photosensitive drum 1*d*. Therefore, because of the drawing-out operation of the developing device 3*d* or drum unit 40*d*, the magnetic roller 27 and the photosensitive drum 1*d* do not contact each other, and there is no risk that the surfaces of the photosensitive drum 1*d* and magnetic roller 27 could be damaged. Accordingly, it becomes possible to remove and replace the developing device 3*d* and the drum unit 40*d* in an arbitrary order.

For example, in a case of removing the drum unit 40*d*, the unlock lever 47 is pushed up to unlock the engagement between the engagement claw disposed at a lower portion of the front side of the drum unit 40*d* and the unit support frame 103, and the drum unit 40*d* is drawn out in the second direction (arrow Z2 direction). Besides, in a case of removing the developing device 3*d*, the unlock lever 37 is pushed up to unlock the engagement between the engagement claw 35 (see FIG. 3) disposed at a lower portion of the front side of the developing device 3*d* and the unit support frame 103, the connection between the developing device 3*d* and the developing holder 105*d* is unlocked, thereafter, the developing device 3*d* is drawn out in the second direction (arrow Z2 direction). Also the other drum units 40*a*-40*c* and the developing devices 3*a*-3*c* become replaceable.

Because of the drawing-out operation of the drum units 40*a*-40*d* in the second direction, the connections between the toner delivery portions 41 of the drum units 40*a*-40*d* and the first connection portions 111*a* of the developer collection mechanism 110 are unlocked, and the pressure force from the first connection portion 111*a* does not act on the shutter member of the toner delivery portion 41. As a result of this, at the same time as the connection between the toner delivery portion 41 and the first connection portion 111*a* is unlocked, the shutter member is moved by the bias force of the bias member (spring and the like) in the direction to close the toner delivery aperture.

Likewise, because of the drawing-out operation of the developing devices 3*a*-3*d* in the second direction, the connections between the developer delivery portions 50*e* of the developing devices 3*a*-3*d* and the second connection portions 111*b* of the developer collection mechanism 110 are unlocked, and the pressure force from the second connection portion 111*b* does not act on the shutter member of the developer delivery portion 50*e*. As a result of this, at the same time as the connection between the developer delivery portion 50*e* and the second connection portion 111*b* is unlocked, the shutter member is moved by the bias force of the bias member (spring and the like) in the direction to close the developer delivery aperture.

In the meantime, the end portion of each developing device 3*a*-3*d* and drum unit 40*a*-40*d* in the downstream side in the first direction (arrow Z1 direction) is provided with a unit side connector (not shown) that is connected to a main body side connector disposed on the rear side frame 102. The main body side connector and the unit side connector compose a drawer connector that electrically connects each developing device 3*a*-3*d* and the image forming apparatus 100 main body to each other, and each drum unit 40*a*-40*d* and the image forming apparatus 100 main body to each other. Because of the drawing-out operation of the drum units 40*a*-40*d* and developing devices 3*a*-3*d* in the second direction, also the connection of the drawer connector is unlocked.

On the other hand, in a case of mounting the developing device 3*d* the drum unit 40*d* in the image forming apparatus 100 main body, first, the developing device 3*d* and the drum unit 40*d* are inserted in the first direction (arrow Z1 direction). And, when the developing device 3*d* is completely inserted to be connected to the developing holder 105*d*, the engagement claw 35 engages with the unit support frame 103, whereby the developing device 3*d* is held in a mounted state. Besides, when the drum unit 40*d* is completely inserted, the engagement claw 45 engages with the unit support frame 103, whereby the drum unit 40*d* is held in a mounted state.

Because of the insertion operation of the drum units 40*a*-40*d* in the first direction, the toner delivery portions 41 of the drum units 40*a*-40*d* and the first connection portions 111*a* of the developer collection mechanism 110 are connected to each other, and the shutter member of the toner delivery portion 41 counters the bias force of the bias member to move in the direction to open the toner delivery aperture.

Likewise, because of the insertion operation of the developing devices 3*a*-3*d* in the first direction, the developer delivery portions 50*e* of the developing devices 3*a*-3*d* and the second connection portions 111*b* of the developer collection mechanism 110 are connected to each other, and the shutter member of the developer delivery portion 50*e* counters the bias force of the bias member to move in the direction to open the developer delivery aperture. Besides, the supply aperture shutter 51 moves in the direction to open the developer supply aperture 50*a* (see FIG. 3 for both).

In the meantime, in the state in which the retainer 85 is opened, the roller contact-separation cam 98 is in the horizontal state shown in FIG. 15. Because of this, the developing devices 3*a*-3*d* inserted in the first direction and supported by the rest portions 97 are disposed at the separation positions. However, the separation position shown in FIG. 15 is a position where the magnetic roller 27 is evacuated from the developing position shown in FIG. 14 to a position slightly (about 2 mm) located apart from the photosensitive drum 1*d;* accordingly, also the position of the developer delivery portion 50*e* moves slightly from the developing position. Accordingly, the developer delivery portion 50*e* is inserted into the second connection portion 111*b* while elastically deforming the seal member 113.

And, at the same time as the insertion of the drum units 40*a*-40*d* and developing devices 3*a*-3*d*, the main body side connector and the unit side connector are connected to each other, and each developing device 3*a*-3*d* and the image forming apparatus 100 main body are electrically connected to each other, and each drum unit 40*a*-40*d* and the image forming apparatus 100 main body are electrically connected to each other.

When swinging the retainer 85 in the closing direction (upward direction) from the state of FIG. 10, as shown in FIG. 11, the tip end of the hook 89 butts the lock pin 101*c*, and the drum shaft $\mathbf{1}d_1$ opposes the bearing hole 87*d*. Here, in a case where the drum shaft 1*d*, and the position of the bearing hole 87*d* somewhat deviate from each other, the drum shaft $\mathbf{1}d_1$ contacts a circumferential edge of the bearing hole 87*d*. However, as described above, the positioning plate 87 is held in the displaceable state by the retainer 85. Because of this, the circumferential edge of the bearing hole 87 is pushed by the drum shaft $\mathbf{1}d_1$, the coil spring 90 is compressed, the positioning plate 87 swings, and the insertion of the drum shaft 1*d*, into the bearing hole 87 is smoothly performed.

And, when further swinging the retainer 85 in the closing direction from the state of FIG. 11, the hook 89 engages with the lock pin 101*c*, and the retainer 85 is held in a closed state. Besides, the positioning plate 87 is pushed against the front side frame 101 by the coil spring 90, and the positioning of the drum shaft $\mathbf{1}d_1$ is completed. Further, the photosensitive drums 1*a*-1*d* are grounded via the coil spring 90 and the positioning plate 87.

Besides, in accordance with the swing of the retainer 85 in the closing direction, the roller contact-separation cam 98 swings from the horizontal state to the elevated state; accordingly, the developing device 3*d* goes to the state of being supported by the roller contact-separation cam 98 and the rest portion 97 at the two positions of the bottom surface of the developing container 50, and the magnetic roller 27 gradually comes close to the photosensitive drum 1*d*. And, as shown in FIG. 12, when the retainer 85 is completely closed, the developing device 3*d* is disposed at the position (developing position) where the magnetic roller 27 comes close to a predetermined distance from the photosensitive drum 1*d*, and an electrostatic latent image on the photosensitive drum 1*d* becomes able to be developed. In this way, the state of FIG. 7 returns.

According to the structure of the present embodiment, because of the opening operation of the retainer 85, the magnetic rollers 27 of the developing devices 3*a*-3*d* separate from the photosensitive drums 1*a*-1*d* of the drum units 40*a*-40*d;* accordingly, it is possible to mount and demount the developing devices 3*a*-3*d* and the drum units 40*a*-40*d* in an arbitrary order without damaging the photosensitive drums 1*a*-1*d* or the magnetic rollers 27. Accordingly, it is possible to smoothly perform the maintenance working and replacement working of the drum units 40*a*-40*d* and developing devices 3*a*-3*d*. Besides, it is unnecessary to provide the developing devices 3*a*-3*d* with a mechanism that evacuates the magnetic rollers 27 from the photosensitive drums 1*a*-1*d;* accordingly, it is possible to simplify the structures of the developing devices 3*a*-3*d*.

Further, in association with the swing of the retainer 85 that always undergoes the opening and closing operations at the mounting and demounting times of the developing devices 3*a*-3*d*, the developing devices 3*a*-3*d* are disposed at the developing position or the separation position. Because of this, there is no risk that the developing devices 3*a*-3*d* could fail to move to the separation position before being removed and the developing devices 3*a*-3*d* could fail to move to the developing position after being mounted.

Besides, the positioning plate 87 is held in the state in which the positioning plate 87 can perform the predetermined displacement with respect to the retainer 85; accordingly, it is possible to smoothly perform the insertion of the drum shafts $\mathbf{1}a_1$-$\mathbf{1}d_1$ into the bearing holes 87*a*-87*d*.

Further, the toner delivery portion 41 and the developer delivery portion 50*e* are each opened and closed by the shutter member in accordance the connections or disconnections between the drum units 40*a*-40*d* and the developer collection mechanism 110 and between the developing devices 3*a*-3*d* and the developer collection mechanism 110; accordingly, it is possible to surely prevent the leak of the toner or developer from the toner delivery portion 41 and the developer delivery portion 50*e*. Besides, the developer supply aperture 50*a* is opened and closed by the supply aperture shutter 51 in accordance with the connections or disconnections between the developing devices 3*a*-3*d* and the developing holder 105*a*-105*d;* accordingly, it is also possible to surely prevent the leak of the developer from the developer supply aperture 50*a*.

Figure 16:
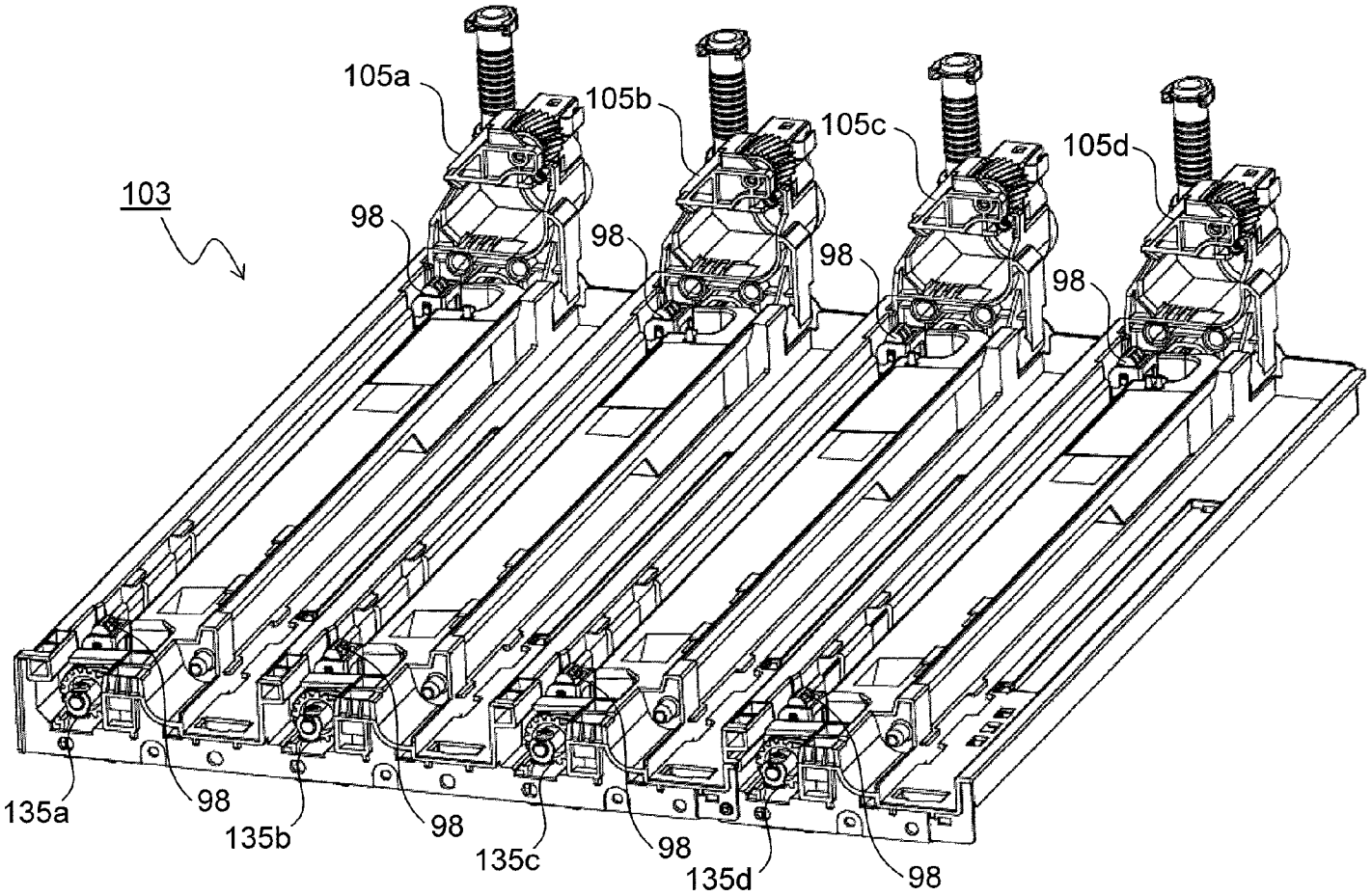
FIG. 16 is a perspective view of the unit support frame 103 used for the image forming apparatus 100 according to a second embodiment of the present disclosure.

Next, the image forming apparatus 100 according to a second embodiment of the present disclosure is described. FIG. 16 is a perspective view of the unit support frame 103 used for the image forming apparatus 100 according to the second embodiment of the present disclosure, and FIG. 17 is a perspective view of a cam drive lever unit 120 used for the image forming apparatus 100 according to the second embodiment.

As shown in FIG. 16, the unit support frame 103 has second idle gears 133*a*-133*d* (see FIG. 20) disposed at four positions of a front end portion (end portion of the front side frame 101) of the unit support frame 103 and cam rotation gears 135*a*-135*d* that mesh with the second idle gears 133*a*-133*d*. The cam rotation gears 135*a*-135*d* and the second idle gears 133*a*-133*d* compose a second gear mechanism that transmits swing force to the roller contact-separation cam 98. The structures of the other portions of the unit support frame 103 are the same as the first embodiment. In the meantime, FIG. 16 shows the state in which the roller contact-separation cam 98 is elevated.

Figure 17:
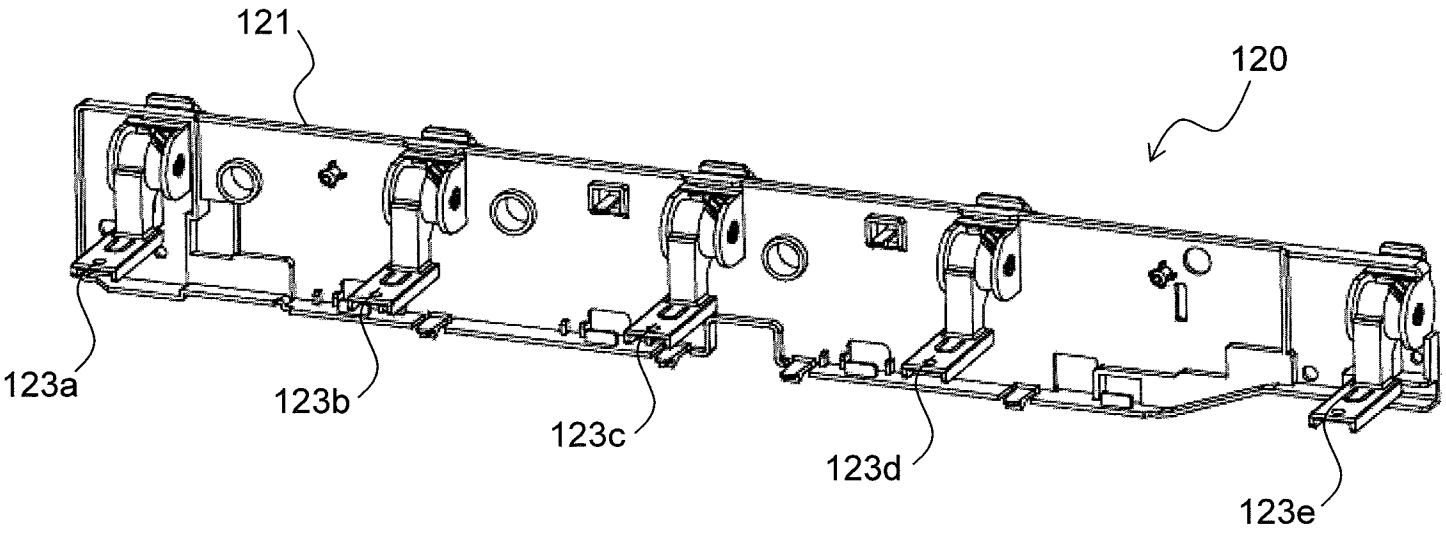
FIG. 17 is a perspective view of a cam drive lever unit 120 used for the image forming apparatus 100 according to the second embodiment.

As shown in FIG. 17, the cam drive lever unit 120 has developing push levers 123*a*-123*e* swingably disposed at five positions of a unit frame 21, cam drive gears 125*a*-125*d* (see FIG. 20) fixed to swing shafts of the developing push levers 123*a*-123*d*, and first idle gears 127*a*-127*d* (see FIG. 20) that mesh with the cam drive gears 125*a*-125*d*. The cam drive gears 125*a*-125*d* and the first idle gears 127*a*-127*d* compose a first gear mechanism into which swing force of the developing push levers 123*a*-123*d* is input.

Figure 18:
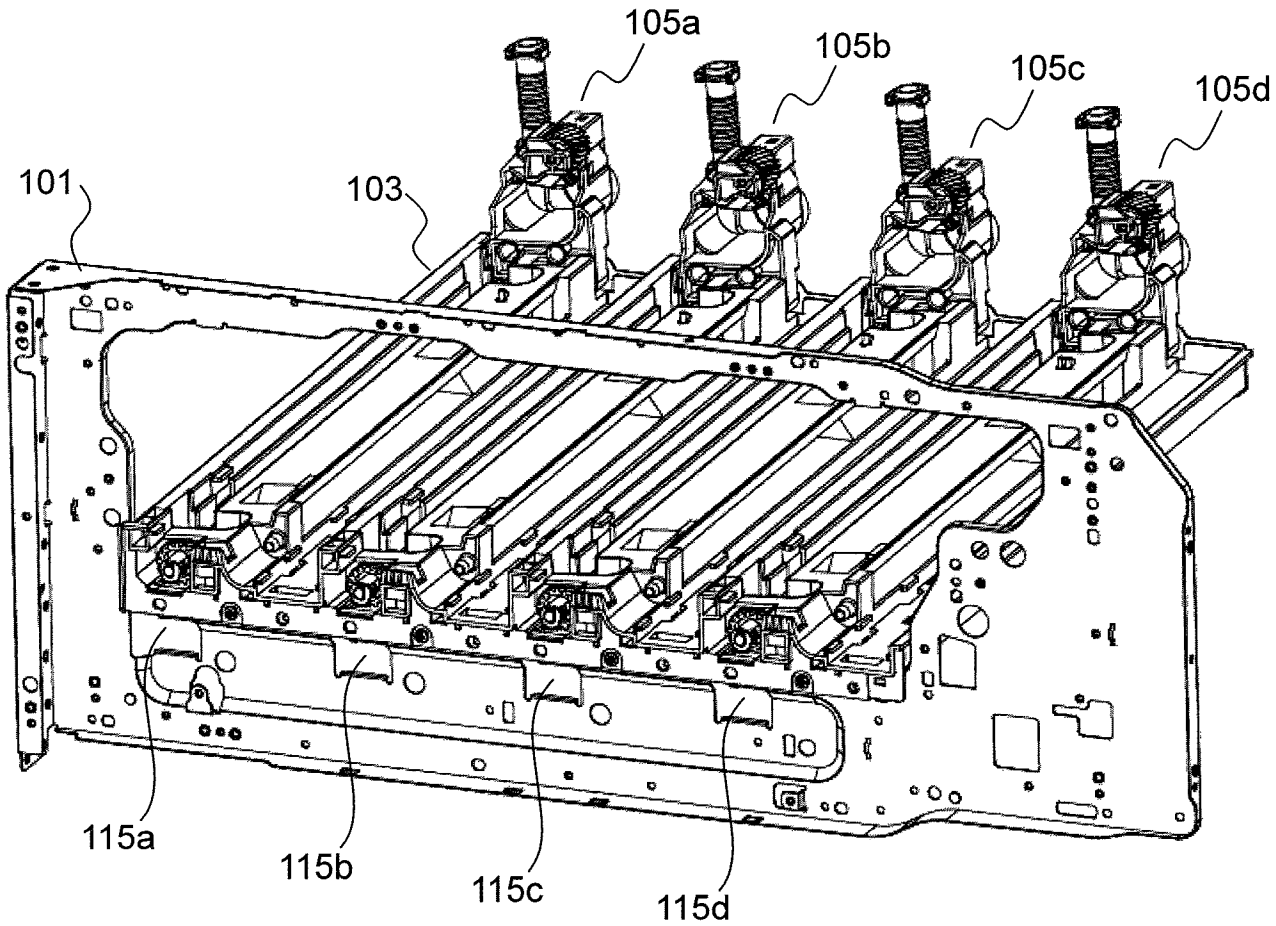
FIG. 18 is a perspective view showing a state in which the unit support frame 103 is mounted in a front side frame 101.

Hereinafter, an assembly procedure of portions around the unit support frame 103 of the image forming apparatus 100 according to the present embodiment is described. First, as shown in FIG. 18, the unit support frame 103 is fixed like a bridge between the front side frame 101 and the rear side frame 102 (see FIG. 6).

Figure 19:
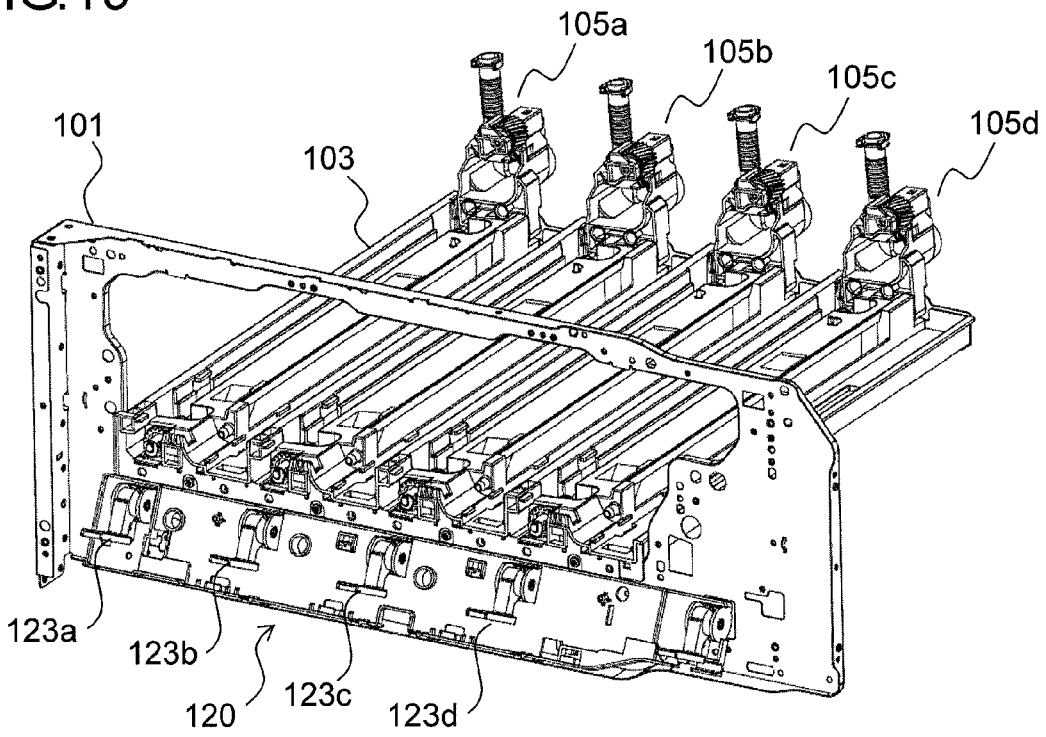
FIG. 19 is a perspective view showing a state in which the cam drive lever unit 120 is mounted in a lower portion of the front side frame 101.

Next, as shown in FIG. 19, the cam drive lever unit 120 is mounted in a lower portion of the front side frame 101. Here, the first idle gears 127*a*-127*d* at the four positions of the unit frame 121 are inserted into aperture holes 115*a*-115*d* (see FIG. 18) at four positions formed through the front side frame 101.

Figure 20:
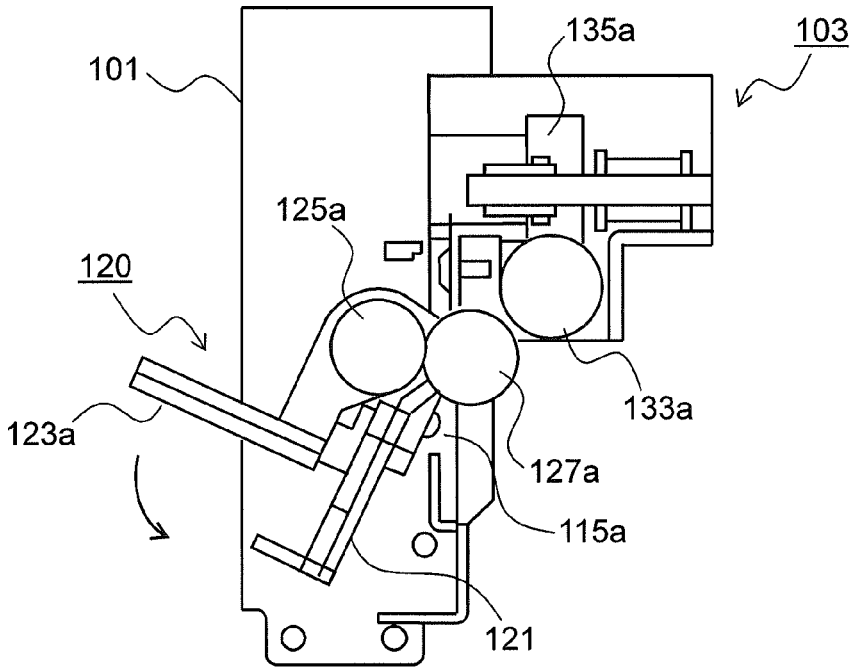
FIG. 20 is a side cross-sectional view showing a structure near a developing push lever 123*a* in the state in which the cam drive lever unit 120 is mounted in the lower portion of the front side frame 101.

FIG. 20 is a side cross-sectional view showing a structure near the developing push lever 123*a* in the state in which the cam drive lever unit 120 is mounted in the lower portion of the front side frame 101. In the meantime, also the structures near the developing push levers 123*b*-123*d* are the same as FIG. 20; accordingly, description of them is skipped. As shown in FIG. 20, the first idle gear 127*a* inserted in the aperture hole 115*a* is disposed to oppose the second idle gear 133*a* of the unit support frame 103. In this state, the first idle gear 127*a* and the second idle gear 133*a* are located apart from each other. Besides, the four pairs (8 positions) of roller contact-separation cams 98 of the unit support frame 103 and the developing push levers 123*a*-123*d* at the four positions of the cam drive lever unit 120 have the same phase as one another (in the fallen state under their own weights).

Figure 21:
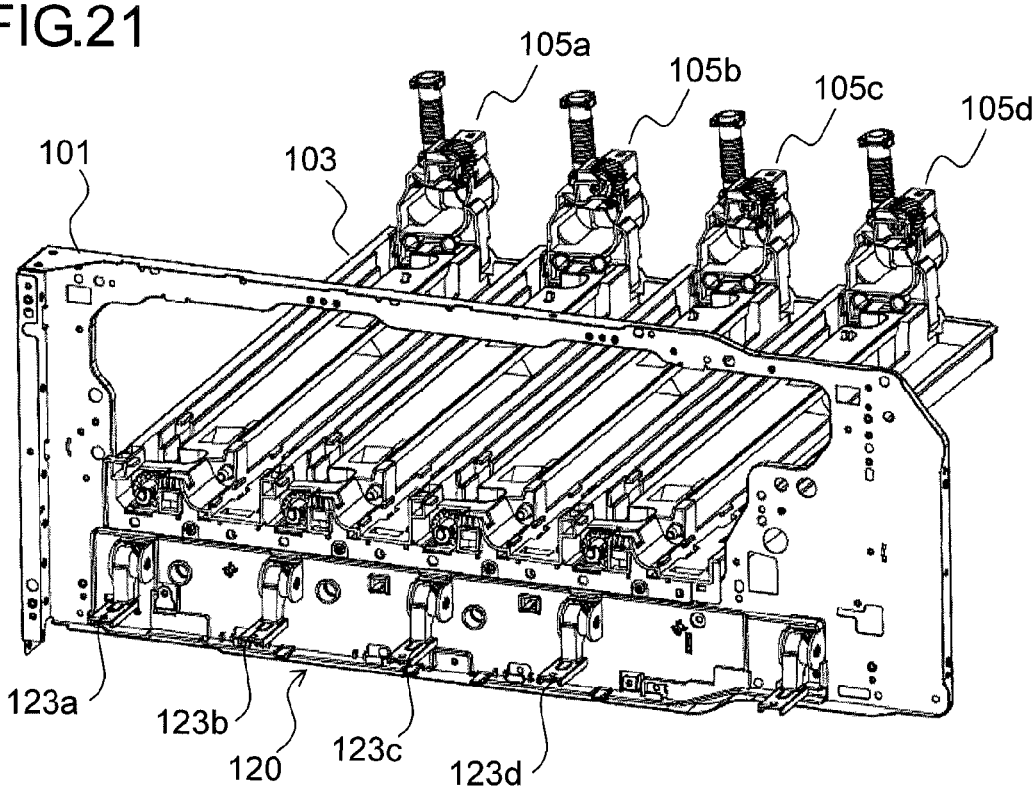
FIG. 21 is a perspective view showing a state in which the cam drive lever unit 120 is swung in a downward direction from the state of FIG. 19 and a unit frame 121 is fixed to the front side frame 101.
Figure 22:
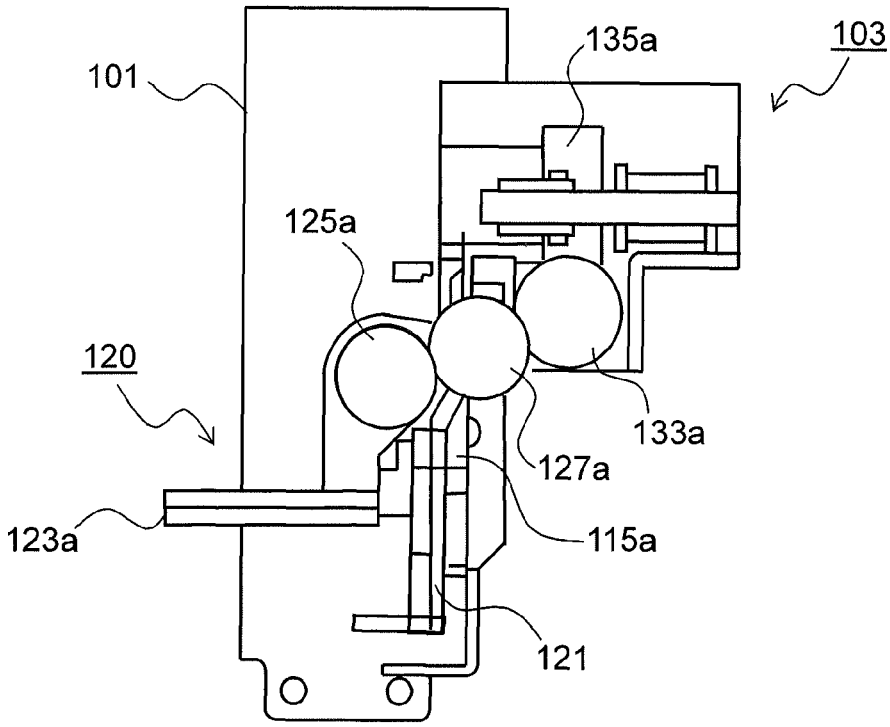
FIG. 22 is a side cross-sectional view near a developing push lever 123*a* in the state in which the unit frame 121 is fixed to the front side frame 101.

From the states of FIG. 19 and FIG. 20, the cam drive lever unit 120 is swung in a downward direction (arrow direction of FIG. 20) to fix the unit frame 121 to the front side frame 101 as shown in FIG. 21. FIG. 22 is a side cross-sectional view near the developing push lever 123*a* in the state in which the unit frame 121 is fixed to the front side frame 101. As shown in FIG. 22, the first idle gear 127*a* is disposed at a position to mesh with the second idle gear 133*a*.

In the meantime, although not shown here, also the first idle gears 127*b*-127*d* corresponding to the developing push levers 123*b*-123*d* are disposed at positions to respectively mesh with the second idle gears 133*b*-133*d*. And, by fixing the retainer 85 (see FIG. 8) to the developing push levers 123*b*-123*e*, the assembly of the portions around the unit support frame 103 is completed.

In the state (opened state) in which the retainer 85 is fixed to the developing push levers 123*a*-123*e*, the roller contact-separation cam 98 is disposed in the horizontal state. Because of this, as shown in FIG. 15, the developing device 3*d* is in the state of being supported at only one position of the bottom surface of the developing container 50 by the rest portion 97 when seeing from the shaft direction of the magnetic roller 27, and the developing device 3*d* is disposed at the position (separation position) where the magnetic roller 27 is evacuated from the photosensitive drum 1*d*.

Thereafter, when the retainer 85 is swung in the closing direction, also the developing push levers 123*a*-123*d* fixed to the retainer 85 swing in an upward direction. In this way, the cam drive gears 125*a*-125*d*, the first idle gears 127*a*-127*d*, the second idle gears 133*a*-133*d*, and the cam rotation gears 135*a*-135*d* rotate by a predetermined angle; accordingly, also the roller contact-separation cams 98 fallen in the horizontal state and disposed at the four positions swing from the horizontal state to the elevated state (see FIG. 16). As a result of this, the developing devices 3*a*-3*d* go to the state of being supported by the roller contact-separation cams 98 and the rest portions 97 (see FIG. 14) at the two positions of the bottom surface of the developing container 50, and the magnetic rollers 27 gradually come close to the photosensitive drums 1*a*-1*d*. And, when the retainer 85 is completely closed, the developing devices 3*a*-3*d* are disposed at the positions (developing position) where the magnetic rollers 27 come to the predetermined distance from the photosensitive drums 1*a*-1*d*.

According to the structure of the present embodiment, by only mounting the cam drive lever unit 120 on the unit support frame 103, it is possible to perform the assembly at the same time in such a manner that the roller contact-separation cams 98 and the developing push levers 123*a*-123*d* have the same phase as one another at the four connection portions. Accordingly, it is possible to perform the gear phase matching at a time at the four connection portions for performing the push and separation of the magnetic rollers 27 against and from the photosensitive drums 1*a*-1*d*, and it is unnecessary to additionally perform the phase matching; accordingly, the assembly time of the image forming apparatus 100 is dramatically reduced.

In the meantime, here, the structure is employed, in which the cam drive gears 125*a*-125*d* near the cam drive lever unit 120 and the cam rotation gears 135*a*-135*d* in the unit support frame 103 are connected to each other in a drive manner via the first idle gears 127*a*-127*d* and the second idle gears 133*a*-133*d*. However, either set of the first idle gears 127*a*-127*d* and the second idle gears 133*a*-133*d* may be removed. Besides, it is also possible to remove both sets of the first idle gears 127*a*-127*d* and the second idle gears 133*a*-133*d* and thereby directly connect the cam drive gears 125*a*-125*d* and the cam rotation gears 135*a*-135*d* to each other.

Besides, the present disclosure is not limited to each of the above embodiments, but it is possible to variously modify the present disclosure within the scope not-departing from the spirit of the present disclosure. For example, in each of the above embodiments, the new developer containing the magnetic carrier and toner is supplied, and the developing devices 3*a*-3*d* are used which deliver the surplus developer from the developer delivery portion 50*e*; however, it is also possible to use a developing device which does not have the developer delivery portion 50*e* and in which only the toner is supplied. In this case, the second connection portion 111 b, which connects the developer delivery portion 50*e* and the developer collection mechanism 110 to each other, becomes unnecessary.

Besides, each of the above embodiments uses the developing devices 3*a*-3*d* of the two-component developing type which use magnetic brushes formed on the circumferential surfaces of the magnetic rollers 27 to develop electrostatic latent images on the photosensitive drums 1*a*-1*d*. However, this is not limiting, but a developing device of developing type may be used, which includes developing rollers as the developing devices 3*a*-3*d*, between the magnetic rollers 27 and the photosensitive drums 1*a*-1*d*, on which a toner layer is formed by the magnetic brushes formed on the magnetic rollers 27, wherein the toner on the developing rollers is flown to the photosensitive drums 1*a*-1*d*. Or, a developing device may be used, which uses magnetic one-component developer.

Besides, the present disclosure is applicable to not only the color printer as shown in FIG. 1 but also other image forming devices such as a monochromatic printer, a monochromatic and color copy machine, a digital multi-functional machine (which has various functions such as a copy machine, a facsimile, a scanner and the like, and is also called a MFP (Multi Function Peripheral)) and the like.

The present disclosure is usable for an image forming apparatus that includes a developing device and an image carrier unit that are mountable and demountable. By using the present disclosure, it is possible to provide an image forming apparatus in which it is possible to surely perform the connection or disconnection between the developing device and the image forming apparatus main body or between the image carrier unit and the image forming apparatus main body during mounting and demounting times of the developing device or image carrier unit, and it is easy to mount or demount the developing device or the image carrier unit into or from the image forming apparatus main body and operability is excellent.

What is claimed is:

1. An image forming apparatus comprising:

an image carrier unit that has an image carrier;

a developing device that has a developer carrier for supplying toner onto the image carrier and is disposed adjacently to the image carrier unit;

a unit support frame that separately supports the image carrier unit and the developing device in a mountable/demountable manner;

a retainer that swings in a first direction, in which the image carrier unit and the developing device are mounted in the unit support frame, to perform positioning of the image carrier, and swings in a second direction, in which the image carrier unit and the developing device are drawn out from an image forming apparatus main body, to unlock a positioned state of the image carrier; and a developing device moving mechanism that associates with the swing of the retainer in the first direction to dispose the developing device at a developing position where the developer carrier comes into contact with or comes close to the image carrier, and associates with the swing of the retainer in the second direction to dispose the developing device at a separation position where the developing device separates the developer carrier from the image carrier; wherein the developing device moving mechanism has: a roller contact-separation cam that is disposed to oppose an end of a bottom surface of the developing device supported by the unit support frame; and a gear mechanism that transmits swing force of the retainer to the roller contact-separation cam, wherein the retainer moves in the first direction or the second direction, whereby the end of the bottom surface of the developing device supported by the unit support frame is moved up and down by the roller contact-separation cam, so that the developing device is disposed at the developing position or the separation position.

2. The image forming apparatus according to claim 1, wherein a plurality of image carrier units and a plurality of developing devices are disposed correspondingly to different colors, and the developing device moving mechanism is able to dispose the plurality of developing devices at a time at either one of the developing position and the separation position.

3. The image forming apparatus according to claim 2, wherein the developing device moving mechanism has a structure that includes:

a plurality of roller contact-separation cams each of which is disposed to oppose an end of a bottom surface of each of the plurality of the developing devices mounted in the unit support frame, and a plurality of second gear mechanisms that transmit swing force to the roller contact-separation cam; and a cam drive lever unit that has: a plurality of developing push levers to which the retainer is fixed; and a plurality of first gear mechanisms into which swing force of the developing push levers is input, wherein when the cam drive lever unit is connected to the unit support frame, the first gear mechanism and the second gear mechanism mesh with each other in such a manner that the plurality of roller contact-separation cams and the plurality of developing push levers have phases identical to each other.

4. The image forming apparatus according to claim 1, wherein the gear mechanism is composed of: a first gear that is connected to a swing shaft of the retainer to rotate in a direction identical to the swing direction of the retainer; and a second gear that is connected to a swing shaft of the roller contact-separation cam to mesh with the first gear in a direction in which rotary shafts are perpendicular to each other.

5. The image forming apparatus according to claim 1, wherein the unit support frame is provided with a developing holder that swingably supports an end portion of the developing device in a downstream side in the first direction, and the developing device associates with the swing of the retainer in the first direction or the second direction to be selectively disposed together with the developing holder at the developing position or the separation position.

6. The image forming apparatus according to claim 1, wherein the image carrier unit and the developing device each have a lock mechanism that is able to separately hold a state of being mounted in the unit support frame and to unlock the holding.

7. An image forming apparatus comprising:

an image carrier unit that has an image carrier;

a developing device that has a developer carrier for supplying toner onto the image carrier and is disposed adjacently to the image carrier unit;

a unit support frame that separately supports the image carrier unit and the developing device in a mountable/demountable manner;

a retainer that swings in a first direction, in which the image carrier unit and the developing device are mounted in the unit support frame, to perform positioning of the image carrier, and swings in a second direction, in which the image carrier unit and the developing device are drawn out from an image forming apparatus main body, to unlock a positioned state of the image carrier; and a developing device moving mechanism that associates with the swing of the retainer in the first direction to dispose the developing device at a developing position where the developer carrier comes into contact with or comes close to the image carrier, and associates with the swing of the retainer in the second direction to dispose the developing device at a separation position where the developing device separates the developer carrier from the image carrier; wherein the retainer has a positioning plate that performs positioning of one end of a rotary shaft of the image carrier, a guide pin that slidably holds the positioning plate in such a manner that the positioning plate comes close to or goes away from the retainer, and a bias member that biases the positioning plate in such a manner that the positioning plate goes away from the retainer.

* * * * *